US010329519B2

(12) United States Patent
Lynch et al.

(10) Patent No.: US 10,329,519 B2
(45) Date of Patent: Jun. 25, 2019

(54) CONSUMER PRODUCT COMPOSITION COMPRISING A POLYETHYLENEGLYCOL CARRIER, SILICONE CONDITIONER, AND PARTICULATE SPACER MATERIAL

(71) Applicant: The Procter & Gamble Company, Cincinnati, OH (US)

(72) Inventors: Matthew Lawrence Lynch, Mariemont, OH (US); Brandon Philip Illie, Felicity, OH (US); Amber Joy Yeary, Park Hills, KY (US); Philip Andrew Sawin, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 143 days.

(21) Appl. No.: 15/728,764

(22) Filed: Oct. 10, 2017

(65) Prior Publication Data

US 2018/0105767 A1 Apr. 19, 2018

Related U.S. Application Data

(60) Provisional application No. 62/410,034, filed on Oct. 19, 2016.

(51) Int. Cl.

| | |
|---|---|
| ***C11D 13/20*** | (2006.01) |
| ***C11D 3/00*** | (2006.01) |
| ***C11D 3/04*** | (2006.01) |
| ***C11D 3/12*** | (2006.01) |
| ***C11D 3/16*** | (2006.01) |
| ***C11D 3/22*** | (2006.01) |
| ***C11D 3/37*** | (2006.01) |
| ***C11D 17/00*** | (2006.01) |
| ***C11D 7/02*** | (2006.01) |
| ***C11D 7/10*** | (2006.01) |

(52) U.S. Cl.

CPC ..... *C11D 3/001* (2013.01); *C11D 3/04* (2013.01); *C11D 3/046* (2013.01); *C11D 3/124* (2013.01); *C11D 3/1246* (2013.01); *C11D 3/162* (2013.01); *C11D 3/222* (2013.01); *C11D 3/373* (2013.01); *C11D 3/3707* (2013.01); *C11D 3/3742* (2013.01); *C11D 3/3749* (2013.01); *C11D 3/3753* (2013.01); *C11D 7/02* (2013.01); *C11D 7/10* (2013.01); *C11D 17/0052* (2013.01)

(58) Field of Classification Search

CPC ..... C11D 13/20

See application file for complete search history.

(56) References Cited

U.S. PATENT DOCUMENTS

| | | | | |
|---|---|---|---|---|
| 4,077,890 | A | 3/1978 | Barker | |
| 4,096,072 | A | 6/1978 | Brock et al. | |
| 4,152,272 | A | 5/1979 | Young | |
| 4,176,079 | A | 11/1979 | Geurry et al. | |
| 4,197,865 | A | 4/1980 | Jacquet et al. | |
| 4,217,914 | A | 8/1980 | Jacquet et al. | |
| 4,381,919 | A | 5/1983 | Jacquet et al. | |
| 4,422,853 | A | 12/1983 | Jacquet et al. | |
| 4,507,280 | A | 3/1985 | Pohl et al. | |
| 4,529,586 | A | 7/1985 | De Marco et al. | |
| 4,652,392 | A | 3/1987 | Baginski et al. | |
| 4,663,158 | A | 5/1987 | Wolfram et al. | |
| 4,765,916 | A | 8/1988 | Ogar, Jr. et al. | |
| 5,104,646 | A | 4/1992 | Bolich, Jr. et al. | |
| 5,106,609 | A | 4/1992 | Bolich, Jr. et al. | |
| 5,154,849 | A * | 10/1992 | Visscher | A61K 8/891 510/150 |
| 5,173,200 | A | 12/1992 | Kellett | |
| RE34,584 | E | 4/1994 | Grote et al. | |
| 5,362,483 | A | 11/1994 | Morgan et al. | |
| 5,674,478 | A | 10/1997 | Dodd et al. | |
| 5,750,122 | A | 5/1998 | Evans et al. | |
| 5,759,208 | A | 6/1998 | Zhen | |
| 5,770,556 | A | 6/1998 | Farrell et al. | |
| 5,783,536 | A | 7/1998 | Farrell et al. | |
| 5,935,917 | A | 8/1999 | Farrell et al. | |
| 6,174,845 | B1 * | 1/2001 | Rattinger | A61K 8/02 510/141 |
| 6,254,892 | B1 | 7/2001 | Duccini et al. | |
| 6,465,407 | B2 | 10/2002 | Hayashi et al. | |
| 6,699,826 | B1 | 3/2004 | Saijo et al. | |
| 6,703,011 | B2 | 3/2004 | Shefer et al. | |
| 6,818,606 | B1 | 11/2004 | Hanada et al. | |
| 7,091,171 | B2 | 8/2006 | Caswell et al. | |
| 7,208,460 | B2 | 4/2007 | Shefer | |

(Continued)

FOREIGN PATENT DOCUMENTS

| | | | |
|---|---|---|---|
| AU | 2012201719 | A1 | 4/2012 |
| CA | 2044043 | C | 4/1998 |

(Continued)

OTHER PUBLICATIONS

International Search Report and Written Opinion dated Jan. 16, 2018, U.S. Appl. No. 15/728,764, 21 pgs.

*Primary Examiner* — Charles I Boyer

(74) *Attorney, Agent, or Firm* — Jason J Camp; James E Oehlenschlager

(57) ABSTRACT

A consumer product composition comprises a non-porous dissolvable solid structure comprising a carrier material, and hydrophobic conditioning agent and particulate spacer material disposed within the carrier material, wherein the hydrophobic conditioning agent has a mean particle size of from about 1 μm to about 500 μm and the particulate spacer material has a mean particle size of from about 55 μm to about 750 μm.

21 Claims, 1 Drawing Sheet

(56) References Cited

U.S. PATENT DOCUMENTS

| | | | | |
|---|---|---|---|---|
| 7,544,651 | B2 | 6/2009 | Caswell et al. | |
| 7,674,758 | B2 | 3/2010 | Wahl et al. | |
| 7,700,530 | B2 | 4/2010 | Mundschau et al. | |
| 7,786,027 | B2 | 8/2010 | Aouad et al. | |
| 7,786,069 | B2 | 8/2010 | Tindel-Koukal et al. | |
| 7,867,986 | B2 | 1/2011 | Houze | |
| 7,871,976 | B1 | 1/2011 | Aouad | |
| 8,084,409 | B2 * | 12/2011 | Lucka | A61K 8/922 424/401 |
| 8,398,961 | B2 | 3/2013 | Kaplan et al. | |
| 8,497,234 | B2 | 7/2013 | Mayer et al. | |
| 9,150,819 | B2 * | 10/2015 | Wetrosky | C11D 1/62 |
| 9,347,022 | B1 * | 5/2016 | Frentzel | C11B 9/00 |
| 2004/0253434 | A1 | 12/2004 | Patel et al. | |
| 2005/0005591 | A1 | 1/2005 | Wieger et al. | |
| 2005/0170996 | A1 | 8/2005 | Blyth et al. | |
| 2005/0202999 | A1 | 9/2005 | Morgan, III et al. | |
| 2006/0217288 | A1 | 9/2006 | Wahl et al. | |
| 2006/0276370 | A1 | 12/2006 | Zhang et al. | |
| 2007/0054815 | A1 | 3/2007 | Convents et al. | |
| 2007/0259170 | A1 | 11/2007 | Brown et al. | |
| 2007/0286904 | A1 | 12/2007 | Poppelwell et al. | |
| 2008/0188388 | A1 * | 8/2008 | Sidwa | C11D 13/14 510/142 |
| 2009/0042766 | A1 | 2/2009 | Mayer et al. | |
| 2009/0220443 | A1 | 9/2009 | Braksmayer et al. | |
| 2009/0281011 | A1 | 11/2009 | Mayer et al. | |
| 2010/0204341 | A1 | 8/2010 | Yu et al. | |
| 2010/0278886 | A1 | 11/2010 | Yu et al. | |
| 2011/0165110 | A1 * | 7/2011 | Kinoshita | A61K 8/042 424/70.27 |
| 2012/0175016 | A1 | 7/2012 | Lopez et al. | |
| 2012/0258902 | A1 | 10/2012 | Parrish et al. | |
| 2013/0095156 | A1 | 4/2013 | Barnhart et al. | |
| 2013/0095717 | A1 | 4/2013 | Vanblarcom et al. | |
| 2014/0030206 | A1 | 1/2014 | Smith et al. | |
| 2014/0115794 | A1 * | 5/2014 | Christensen | C11D 1/62 8/137 |
| 2014/0179587 | A1 | 6/2014 | Brown | |
| 2015/0376548 | A1 * | 12/2015 | Wetrosky | C11D 1/62 8/137 |
| 2016/0145537 | A1 * | 5/2016 | Blattner | C11D 3/001 510/516 |
| 2016/0145539 | A1 | 5/2016 | Blattner | |
| 2016/0298058 | A1 | 10/2016 | Christensen | |
| 2016/0304808 | A1 | 10/2016 | Lynch et al. | |
| 2016/0304809 | A1 | 10/2016 | Lynch et al. | |
| 2016/0304810 | A1 | 10/2016 | Lynch et al. | |
| 2016/0304811 | A1 | 10/2016 | Lynch et al. | |
| 2016/0304812 | A1 | 10/2016 | Lynch et al. | |
| 2016/0304819 | A1 | 10/2016 | Lynch et al. | |

FOREIGN PATENT DOCUMENTS

| | | | |
|---|---|---|---|
| DE | 19904233 | | 8/2000 |
| DE | 102007059296 | A1 | 6/2009 |
| DE | 102006034051 | A1 | 5/2016 |
| EP | 0334430 | | 9/1989 |
| EP | 211589 | B1 | 11/1990 |
| EP | 1201745 | A1 | 5/2002 |
| IN | 200301 | B | 8/2007 |
| KR | 2012021449 | A | 3/2012 |
| WO | WO 9749381 | A1 | 12/1997 |
| WO | WO 2001016280 | A2 | 3/2001 |
| WO | WO 2005005591 | | 1/2005 |
| WO | WO 2006088980 | A1 | 8/2006 |
| WO | 2008009521 | * | 1/2008 |
| WO | WO 2008009521 | A1 | 1/2008 |
| WO | WO 2009006218 | A2 | 1/2009 |
| WO | WO 2013036662 | | 3/2013 |
| WO | WO2014018985 | | 1/2014 |
| WO | WO2014018986 | | 1/2014 |
| WO | WO2014018988 | | 1/2014 |
| WO | WO2014018989 | | 1/2014 |
| WO | WO 2014099879 | A1 | 6/2014 |
| WO | WO 2016/078941 | | 5/2016 |
| WO | WO 2016078942 | | 5/2016 |
| WO | WO 2016081006 | | 5/2016 |

* cited by examiner

CONSUMER PRODUCT COMPOSITION COMPRISING A POLYETHYLENEGLYCOL CARRIER, SILICONE CONDITIONER, AND PARTICULATE SPACER MATERIAL

FIELD OF THE INVENTION

The present invention relates to a consumer product composition comprising a non-porous dissolvable solid structure comprising a carrier material, a hydrophobic conditioning agent, and a particulate spacer material disposed in the carrier material.

BACKGROUND OF THE INVENTION

Consumer product compositions often contain benefit agents, such as conditioning agents, to provide enhancements to surfaces treated with the consumer product composition such as improved hand feel benefits (e.g. soft, silky feel), softness benefits, fabric protection benefits, and the like. Such benefits are desired by consumers of fabric care products, such as laundry detergents or fabric softeners.

Such consumer product compositions, such as fabric softeners, are typically provided in the form of aqueous liquid products. Since many desirable conditioning agents are hydrophobic in nature, it can be a challenge to create a stable aqueous liquid formulation containing hydrophobic conditioning agents. As a result, such conditioning agents are typically incorporated in aqueous liquid compositions in the form of emulsions or other systems comprising emulsion droplets/particles having relatively small particle size benefits agents, typically smaller than 1 μm. One drawback of having small particle size conditioning agents is that it can be difficult to deposit and retain small particle size benefit agents on the treated surface, especially if the surfaces are being treated in the context of an aqueous treatment liquor such as a detergent treatment liquor in a laundry washing machine. As a result, the small particle size conditioning agents can be washed down the drain and therefore wasted, as opposed to being deposited and retained on surfaces to enhance the surface.

In order to address such drawbacks, attempts have been made to provide delivery systems, such as encapsulation systems, for the hydrophobic conditioning agents in order to enhance their deposition and retention on surfaces while remaining stable in an aqueous liquid product. These delivery systems, however, can limit the effectiveness of the conditioning agents or lead to other issues.

With respect to the use of relatively large particle size conditioning agents in dissolvable solid structures, such consumer product compositions have the potential to adhere or smear against the treated fibrous surface before the solid structure fully dissolves. This can lead the consumer product composition to cause undesired residue on, or staining of, the treated surface, such as staining of fabrics treated with the consumer product composition under stress conditions (e.g. high loading of laundry in a gentle washing cycle).

It is therefore desired to provide a consumer product composition that contains relatively large particle size conditioning agents without the need for liquid delivery systems that can interfere with the effectiveness of the conditioning agent being deposited on the treated surfaces and without causing undesired residue on, or staining of, the treated surfaces.

SUMMARY OF THE INVENTION

The present invention relates to a consumer product composition comprising a non-porous dissolvable solid structure comprising a carrier material, wherein a hydrophobic conditioning agent and a particulate spacer material are disposed within the carrier material of the non-porous dissolvable solid structure, and wherein the non-porous dissolvable solid structure of the consumer product composition comprises a volume fraction of the particulate spacer material of from about 0.05 to about 0.50.

The non-porous dissolvable solid structure comprises carrier material within which the hydrophobic conditioning agent and particulate spacer material are disposed. The carrier material is selected such that the desired mean particle size of the hydrophobic conditioning agent can be "set" in the carrier material of the non-porous dissolvable solid structure, and the particulate spacer material can be dispersed. The desired mean particle size of hydrophobic conditioning agent in the consumer product composition is in the range of from about 1 μm to about 500 μm. The optimal particle size of the hydrophobic conditioning agent may depend upon the intended use of the consumer product composition. For instance, a fabric softening product composition for conditioning fabrics in a laundry process will preferably contain a hydrophobic conditioning agent having a mean particle size of from about 1 μm to about 500 μm, preferably from about 2 μm to about 500 μm, more preferably from about 2 μm to about 120 μm, more preferably from about 2 μm to about 70 μm, more preferably from about 5 μm to about 25 μm. Since the consumer product composition is in a solid, non-porous form, the mean particle size of the hydrophobic conditioning agent will generally remain constant during packaging, shipping and storage of the consumer product composition.

The particulate spacer material has a mean particle size of from about 55 μm to about 750 μm, and may typically have a mean particle size that is larger than the mean particle size of the hydrophobic conditioning agent. The particulate spacer material will be water-insoluble or will have a dissolution rate such that a ratio of dissolution rate of the carrier material to dissolution rate of the particulate spacer material is at least about 2.

When the consumer product composition is ready for use, it can be dissolved in an aqueous solution to form an aqueous treatment liquor. Upon dissolution, the hydrophobic conditioning agent will tend to maintain its mean particle size from the consumer product composition and into the aqueous treatment liquor. The relatively large particles of hydrophobic conditioning agent in the aqueous treatment liquor will tend to be more effectively deposited on the treated surfaces and therefore provide enhanced consumer benefits, as compared to products which provide smaller mean particle size agents.

As the consumer product composition is dissolved during use, the hydrophobic conditioning agent particles can become exposed at the surface of the non-porous dissolvable solid structure. This has the potential to cause the composition to adhere to, or smear against, the treated surface, such as fabrics in an aqueous treatment liquor of a washing process. The particulate spacer material, having a relatively larger mean particle size than the hydrophobic conditioning agent, will tend to minimize the adherence or smearing of the composition to the treated surface by providing sufficient spacing between the surface of the non-porous dissolvable solid structure (e.g. having the exposed hydrophobic conditioning agent) and the treated surface.

DETAILED DESCRIPTION OF THE INVENTION

Figure 1:
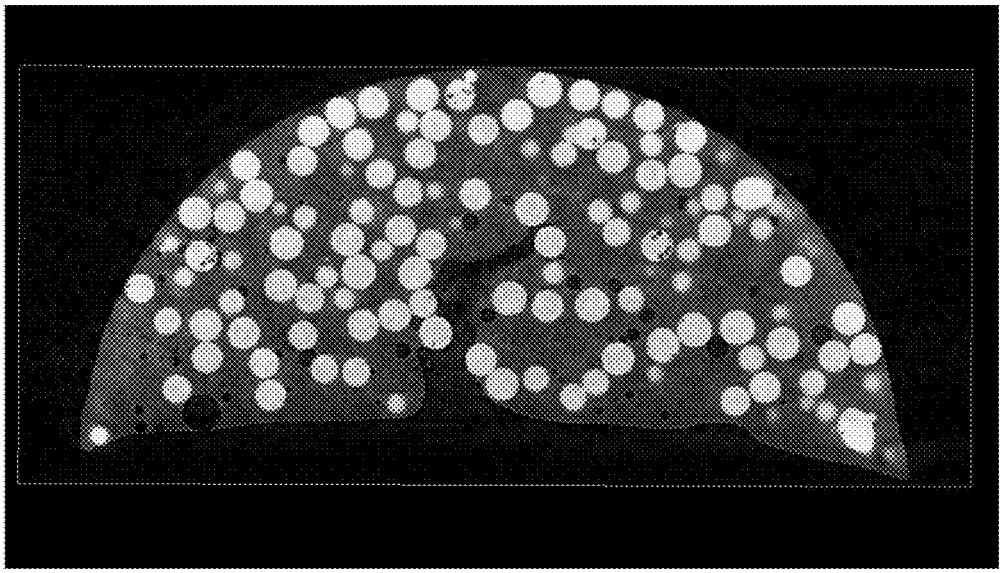
FIG. 1 is a micrograph of magnified cross-sectional view of a consumer product composition of the present invention.

The present invention relates to a consumer product composition comprising a non-porous dissolvable solid structure comprising a carrier material, a particulate spacer material, and a hydrophobic conditioning agent disposed within the carrier material of the non-porous dissolvable solid structure, wherein the hydrophobic conditioning agent has a mean particle size of from about 1 μm to about 500 μm and the particulate spacer material has a mean particle size of from about 55 μm to about 750 μm.

As used herein, consumer product compositions generally encompass fabric care product compositions, such as fabric conditioning (including softening), laundry detergency, laundry and rinse additive and/or care, and other cleaning for consumer or institutional use.

Suitable consumer product compositions are selected from the group consisting of laundry rinse additive product compositions, laundry detergent product compositions, fabric softening product compositions, and combinations thereof.

Non-Porous Dissolvable Solid Structure

The non-porous dissolvable solid structure of the present invention comprises a carrier material. The carrier material serves to "carry" or "hold" the hydrophobic conditioning agent and the particulate spacer material. The hydrophobic conditioning agent is disposed, as particles, within the carrier material of the non-porous dissolvable solid structure and has a mean particle size of from about 1 μm to about 500 μm. The non-porous dissolvable solid structure is capable of dissolving in an aqueous solution to form an aqueous treatment liquor. The dissolution of the non-porous dissolvable solid structure facilitates delivery of the relatively large particles of conditioning agent in the aqueous treatment liquor. The particles of conditioning agent in the aqueous treatment liquor tend to maintain the same mean particle size as the conditioning agent contained in the carrier material of the non-porous dissolvable solid structure prior to dissolution. The conditioning agent can therefore be more effectively deposited and remain on surfaces treated with the aqueous treatment liquor.

With respect to the non-porous dissolvable solid structure, the term "solid" as used herein means that the non-porous dissolvable solid structure has structural rigidity and resistance to change in shape or volume under its own weight (i.e. the weight of the non-porous dissolvable solid structure) at 25° C. As such, the term "solid" includes semi-solids which can change shape or volume under an applied pressure greater than atmospheric pressure. In one aspect, the non-porous dissolvable solid structure is a solid and not a semi-solid.

With respect to the non-porous dissolvable solid structure, the term "non-porous" as used herein means that the non-porous dissolvable solid structure is substantially free of spaces or holes through which liquid or air can pass through the non-porous dissolvable solid structure, such spaces or holes generally having cross-sectional areas of up to about 0.2 $mm^2$ each (e.g. up to about 500 μm diameter dimensions). As such, the term "non-porous dissolvable solid structure" herein does not encompass nonwoven fibrous webs or open-cell foam materials. And as such, the term "non-porous dissolvable solid structure" herein can encompass shapes having larger spaces or holes, such as doughnut-shaped dissolvable solid structures.

The consumer product composition, as a whole, is therefore preferably a non-porous solid consumer product composition (at 25° C.).

Carrier Material

The consumer product composition of the present invention will comprise a carrier material, within which the hydrophobic conditioning agent and particulate spacer material is disposed. The carrier material will generally comprise a significant portion of the consumer product composition and serves to maintain the desired mean particle size of the hydrophobic conditioning agent in the consumer product composition.

The consumer product composition of the present invention will typically comprise carrier material at a level of at least about 5%, preferably at least about 10%, preferably at least about 20%, preferably at least about 30%, preferably at least about 50%, preferably at least about 60%, preferably at least about 65%, by weight of the consumer product composition. The consumer product composition of the present invention will typically comprise carrier material at a level of less than about 95%, preferably less than about 90%, preferably less than about 85%, by weight of the consumer product composition. Preferred ranges of carrier material are from about 30% to about 95%, from about 30% to about 90%, from about 35% to about 80%, or from about 35% to about 70%, by weight of the consumer product composition.

The consumer product composition preferably comprises a ratio of the level of carrier material to the level of hydrophobic conditioning agent of at least about 1:1, preferably from about 1:1 to about 20:1, preferably from about 1:1 to about 10:1, preferably from about 1:1 to about 5:1, preferably from about 1:1 to about 3:1, by weight of the consumer product composition.

The carrier material preferably has a viscosity at 70° C. (as determined according to the VISCOSITY TEST METHOD below), in the range of from about 0.005 to about 350 Pa·s, preferably from about 0.005 to about 100 Pa·s, preferably from about 0.05 to about 50 Pa·s, preferably from about 0.1 to about 15 Pa·s, preferably from about 0.3 to about 15 Pa·s, preferably from about 0.5 to about 15 Pa·s.

The carrier material is generally a solid at ambient temperature (e.g. 25° C.) and can become liquid at elevated temperatures to facilitate incorporation of the hydrophobic conditioning agent in the carrier material at the desired mean particle size. The carrier material preferably becomes liquid (e.g. has a melting point) at a temperature of from about 25° C. to about 120° C., preferably from about 35° C. to about 100° C., preferably from about 40° C. to about 80° C. In preferred aspects, the carrier material is a solid at 25° C. and/or a liquid at 70° C.

The carrier material will typically be selected such that the carrier material portion of the non-porous dissolvable solid structure (and, e.g., the consumer product composition) disperses completely in 25° C. water within a Dissolution Time of less than about 30 minutes, preferably less than about 20 minutes, preferably less than about 10 minutes. Such Dissolution Time can, for instance, be impacted by the nature of the carrier material and/or the size of the consumer product composition. The complete dissolution and associated Dissolution Time of a consumer product composition (such as those in the form of a bead) is determined according to the DISSOLUTION TIME TEST METHOD described below.

The dissolution rate of the carrier material will be greater than the dissolution rate of the particulate spacer material.

This allows the particulate spacer material to provide the desired spacing between the treated surface and the surface of the non-porous dissolvable solid structure, as the carrier material of the non-porous dissolvable solid structure dissolves.

The carrier material preferably comprises a polyethylene glycol ("PEG") material. The carrier material can comprise a single PEG material or a mixture of different PEG materials (e.g. PEG materials having different average molecular weights). The carrier material can further comprise materials miscible with other carrier materials, e.g. in a liquefied state, such as materials miscible with, e.g. liquefied, polyethylene glycol carrier material.

Polyethylene Glycol Material

Polyethylene glycol ("PEG") materials are preferred carrier materials of the non-porous dissolvable solid structure of the present invention, as PEG materials generally have a relatively low cost, may be formed into many different shapes and sizes, dissolve well in water, and liquefy at elevated temperatures. PEG materials come in various molecular weights. In the consumer product compositions of the present invention, the carrier material comprising a PEG material having a molecular weight of from about 200 to about 50,000, preferably from about 500 to about 20,000, preferably from about 1,000 to about 15,000, preferably from about 1,500 to about 12,000, alternatively from about 7,000 to about 9,000, alternatively combinations thereof.

Suitable carrier materials include PEG material having a molecular weight of about 8,000, PEG material having a molecular weight of about 400, PEG material having a molecular weight of about 20,000, or mixtures thereof. Suitable PEG materials are commercially available from BASF under the trade name PLURIOL, such as PLURIOL E 8000.

As used herein, the molecular weight of the PEG material is determined by the MOLECULAR WEIGHT TEST METHOD described hereinbelow.

The carrier material can comprise a mixture of different PEG materials. Such mixture of PEG materials preferably provides a carrier material having the desired properties of the carrier material as a whole, e.g. viscosity at 70° C., melting point, water solubility, and the like, of the carrier material. In one aspect, the carrier material comprises a PEG material having a molecular weight of about 8,000 and a second PEG material having a molecular weight of about 400.

The consumer product compositions of the present invention may comprise at least about 5%, preferably at least about 10%, preferably at least about 20%, preferably at least about 30%, preferably from about 30% to about 95%, preferably from about 50% to about 95%, by weight of the consumer product composition, of a PEG carrier material. Alternatively, the consumer product compositions can comprise from about 80% to about 90%, alternatively from about 85% to about 90%, and alternatively more than about 75%, alternatively from about 70% to about 98%, alternatively from about 80% to about 95%, alternatively combinations thereof and any whole percentages or ranges of whole percentages within any of the aforementioned ranges, of PEG material by weight of the consumer product composition.

PEG materials further include material that might comprise monomers other than ethylene oxide, in particular at low levels. Examples of such monomers include propylene oxide, and other alkylene oxides, glycidyl and other epoxide-containing, formaldehyde, organic alcohols or other polyol monomers. Inclusion of such monomers in the PEG material may be used so long as the PEG material is solid at room temperature.

Hydrophobic Conditioning Agent

The consumer product composition of the present invention comprises a hydrophobic conditioning agent disposed within the carrier material of the non-porous dissolvable solid structure of the consumer product composition. The hydrophobic conditioning agent of the present invention functions to enhance surfaces treated with the consumer product composition to provide improved hand feel benefits (e.g. soft, silky feel), softness benefits, or the like. The term "hydrophobic conditioning agent" as used herein does not encompass perfumes or perfume materials. The hydrophobic conditioning agent is preferably a hydrophobic fiber conditioning agent for treating fibrous surfaces, such as fabrics.

The desired mean particle size of the hydrophobic conditioning agent is set and maintained via the carrier material within which the hydrophobic conditioning agent is disposed.

Hydrophobic conditioning agents include materials which are used to give a particular conditioning benefit (i.e. softening benefit) to fabrics. Suitable conditioning agents include those which deliver one or more benefits relating to softness, antistatic properties, anti-wrinkle properties, wet-handling, fiber damage prevention, and the like. The conditioning agents useful in the compositions of the present invention typically comprise a water-insoluble, non-volatile liquid. Suitable conditioning agents for use in the composition are those conditioning agents characterized generally as silicones (e.g., silicone oils, aminosilicones, cationic silicones, silicone gums, high refractive silicones, functionalized silicones, silicone resins, alkyl siloxane polymers, and cationic organopolysiloxanes), organic conditioning oils (e.g., hydrocarbon oils, polyolefins, fatty esters, metathesized unsaturated polyol esters, and silane-modified oils) or combinations thereof, or those conditioning agents which otherwise form liquid, dispersed particles in the carrier material of the non-porous dissolvable solid structure. Suitable conditioning agents are selected from the group consisting of silicones, organic conditioning oils, hydrocarbon oils, fatty esters, metathesized unsaturated polyol esters, silane-modified oils, other conditioning agents, and mixtures thereof.

The concentration of the conditioning agent in the composition should be sufficient to provide the desired conditioning benefits. Such concentration can vary with the conditioning agent, the conditioning performance desired, the type and concentration of other components, and other like factors such as dosage amount at point of use by the consumer.

The hydrophobic conditioning agent utilized in the present invention will generally have a viscosity at 70° C. (as measured at 70° C. according to the VISCOSITY TEST METHOD below) of at least about 0.01 Pa·s (10 centipoise), preferably from about 0.1 Pa·s (100 centipoise) to about 2000 Pa·s (2,000,000 centipoise), preferably from about 0.1 Pa·s (100 centipoise) to about 150 Pa·s (150,000 centipoise), preferably from about 0.2 Pa·s (200 centipoise) to about 20 Pa·s (20,000 centipoise), preferably from about 0.5 Pa·s (500 centipoise) to about 10 Pa·s (10,000 centipoise).

In preferred aspects, the hydrophobic conditioning agent is liquid at ambient temperature (e.g. 25° C.). The preferred liquid hydrophobic conditioning agent will typically have a viscosity at 25° C. of from about 0.01 Pa·s (10 centipoise), preferably from about 0.1 Pa·s (100 centipoise) to about 2000 Pa·s (2,000,000 centipoise), preferably from about 0.1

Pa·s (100 centipoise) to about 150 Pa·s (150,000 centipoise), preferably from about 0.1 Pa·s (100 centipoise) to about 20 Pa·s (20,000 centipoise), preferably from about 0.5 Pa·s (500 centipoise) to about 15 Pa·s (15,000 centipoise). The viscosity of the hydrophobic conditioning agent at 25° C. is determined according to the VISCOSITY TEST METHOD below, except that the Peltier Plate temperature is set to 25° C. (instead of 70° C.), and the Instrument Procedures and Settings (IPS) "Temperature" settings are 25° C. (instead of 70° C.).

In some aspects, it is believed that if the viscosity of the hydrophobic conditioning agent is too high, upon dissolution of the carrier material, the particles of the hydrophobic conditioning agent in the aqueous treatment liquor may deposit on the target substrate, but may not adequately deform and/or spread over the surface of the substrate, particularly if the substrate is a fibrous substrate such as fabric. If the conditioning agent does not adequately deform and/or spread over the substrate, any conditioning benefit may be incomplete as the conditioning agent may not spread evenly or thoroughly over the substrate. Further, if the disposition of the hydrophobic conditioning agent over the substrate includes regions of high local concentration of the hydrophobic conditioning agent, these regions of high concentration can become highly visible and appear as spots on fabric. Alternately, if the viscosity of the hydrophobic conditioning agent is too low, the relatively large particles that were maintained by the carrier material in the consumer product may further break-down in the aqueous treatment liquor, resulting in smaller particles which may not deposit on the target surface as well.

The consumer product composition of the present invention will typically comprise hydrophobic conditioning agent at a level of at least about 1%, preferably at least about 5%, preferably at least about 8%, preferably at least about 12%, by weight of the consumer product composition. The consumer product composition of the present invention will typically comprise hydrophobic conditioning agent at a level of less than about 50%, preferably less than about 40%, preferably less than about 30%, or preferably less than about 20%, by weight of the consumer product composition. Preferred ranges of hydrophobic conditioning agent are from about 1% to about 50%, from about 5% to about 40%, from about 10% to about 40%, from about 7% to about 35%, from about 10% to about 25%, or from about 15% to about 20%, by weight of the consumer product composition.

Silicones

The conditioning agent of the compositions of the present invention is preferably a water-insoluble silicone conditioning agent. The silicone conditioning agent may comprise volatile silicone, non-volatile silicone, or combinations thereof. Preferred are non-volatile silicone conditioning agents. If volatile silicones are present, it will typically be incidental to their use as a solvent or carrier for commercially available forms of non-volatile silicone material ingredients, such as silicone gums and resins. The silicone conditioning agent particles may comprise a silicone fluid conditioning agent and may also comprise other ingredients, such as a silicone resin to improve silicone fluid deposition efficiency.

Suitable silicones are selected from the group consisting of siloxanes, silicone gums, aminosilicones, terminal aminosilicones, alkyl siloxane polymers, cationic organopolysiloxanes, and mixtures thereof.

The concentration of the silicone conditioning agent typically ranges from about 1% to about 50%, in one aspect from about 5% to about 40%, in one aspect from about 10% to about 40%, in another aspect from about 12% to about 40%, or in another aspect from about 15% to about 30%, by weight of the consumer product composition. Non-limiting examples of suitable silicone conditioning agents are described in U.S. Reissue Pat. No. 34,584, U.S. Pat. No. 5,104,646, and U.S. Pat. No. 5,106,609.

The hydrophobic conditioning agents of the present invention may comprise one or more silicones including high molecular weight polyalkyl or polyaryl siloxanes and silicone gums; lower molecular weight polydimethyl siloxane fluids; and aminosilicones.

Higher molecular weight silicone compounds useful herein include polyalkyl or polyaryl siloxanes with the following structure:

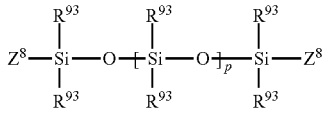

wherein $R^{93}$ is alkyl or aryl, and p is an integer from about 1,300 to about 15,000, more preferably from about 1,600 to about 15,000. $Z^8$ represents groups which block the ends of the silicone chains. The alkyl or aryl groups substituted on the siloxane chain ($R^{93}$) or at the ends of the siloxane chains $Z^8$ can have any structure as long as the resulting silicone remains fluid at room temperature, is neither irritating, toxic nor otherwise harmful, is compatible with the other components of the composition, is chemically stable under normal use and storage conditions, and is capable of being deposited on the target surface. Suitable $Z^8$ groups include hydroxy, methyl, methoxy, ethoxy, propoxy, and aryloxy. The $R^{93}$ groups may represent the same group or different groups. Preferably, the $R^{93}$ groups represent the same group. Suitable $R^{93}$ groups include methyl, ethyl, propyl, phenyl, methylphenyl and phenylmethyl. Other silicone compounds include polydimethylsiloxane, polydiethylsiloxane, and polymethylphenylsiloxane. Commercially available silicone compounds useful herein include, for example, those available from the General Electric Company in their TSF451 series, and those available from Dow Corning in their Dow Corning SH200 series.

The silicone compounds that can be used herein can also include a silicone gum. The term "silicone gum", as used herein, means a polyorganosiloxane material having a viscosity at 25° C. of greater than or equal to 1,000 Pa·s. It is recognized that the silicone gums described herein can also have some overlap with the above-disclosed silicone compounds. This overlap is not intended as a limitation on any of these materials. The "silicone gums" will typically have a molecular weight in excess of about 165,000, generally between about 165,000 and about 1,000,000. Specific examples include polydimethylsiloxane, poly(dimethylsiloxane methylvinylsiloxane) copolymer, poly(dimethylsiloxane diphenylsiloxane methylvinylsiloxane) copolymer and mixtures thereof. Commercially available silicone gums useful herein include, for example, TSE200A and CF330M available from the General Electric Company.

Lower molecular weight silicone compounds useful herein include polyalkyl or polyaryl siloxanes with the following structure:

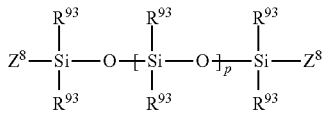

wherein $R^{93}$ is alkyl or aryl, and p is an integer from about 7 to about 850, more preferably from about 7 to about 665. $Z^8$ represents groups which block the ends of the silicone chains. The alkyl or aryl groups substituted on the siloxane chain ($R^{93}$) or at the ends of the siloxane chains $Z^8$ can have any structure as long as the resulting silicone remains fluid at room temperature, is neither irritating, toxic nor otherwise harmful, is compatible with the other components of the composition, is chemically stable under normal use and storage conditions, and is capable of being deposited on the target surface. Suitable $Z^8$ groups include hydroxy, methyl, methoxy, ethoxy, propoxy, and aryloxy. The $R^{93}$ groups may represent the same group or different groups. Preferably, the $R^{93}$ groups represent the same group. Suitable $R^{93}$ groups include methyl, ethyl, propyl, phenyl, methylphenyl and phenylmethyl. Other silicone compounds include polydimethylsiloxane, polydiethylsiloxane, and polymethylphenylsiloxane. Commercially available these silicone compounds useful herein include, for example, those available from the General Electric Company in their TSF451 series, and those available from Dow Corning in their Dow Corning SH200 series.

In one aspect, the hydrophobic conditioning agent of the present invention includes one or more aminosilicones Aminosilicones, as provided herein, are silicones containing at least one primary amine, secondary amine, tertiary amine, or quaternary ammonium group. Preferred aminosilicones may have less than about 1% nitrogen by weight of the aminosilicone, more preferably less than about 0.2%, more preferably still, less than about 0.1%. It should be understood that in some product forms, higher levels of nitrogen are acceptable in accordance with the present invention.

Non-limiting examples of aminosilicones for use in aspects of the subject invention include, but are not limited to, those which conform to the general formula (I):

$$(R^1)_aG_{(3-a)}\text{-Si}—(—OSiG_2)_n\text{-}(—OSiG_b(R^1)_{2-b})_m—O\text{-}SiG_{(3-a)}(R^1)_a \quad (I)$$

wherein G is hydrogen, phenyl, hydroxy, or $C_1$-$C_8$ alkyl, preferably methyl; a is 0 or an integer having a value from 1 to 3, preferably 1; b is 0, 1, or 2, preferably 1; wherein when a is 0, b is not 2; n is a number from 0 to 1,999; m is an integer from 0 to 1,999; the sum of n and m is a number from 1 to 2,000; a and m are not both 0; $R^1$ is a monovalent radical conforming to the general formula $C_qH_{2q}L$, wherein q is an integer having a value from 2 to 8 and L comprises at least one amine group. Preferably L is selected from the following groups: $—N(R^2)CH_2—CH_2—N(R^2)_2$; $—N(R^2)_2$; $—N(R^2)+_3A^-$; $—N(R^2)CH_2—CH_2—NR^2H_2A^-$; wherein $R^2$ is hydrogen, phenyl, benzyl, or a saturated hydrocarbon radical, preferably an alkyl radical from about $C_1$ to about $C_{20}$; $A^-$ is a halide ion. Preferably L is $—N(R^2)CH_2—CH_2—N(R^2)_2$, wherein q=3 and $R^2$=H (such a material is available from Momentive Performance Materials Inc. under the tradename MAGNASOFT PLUS).

Some silicones for use herein can include those aminosilicones that correspond to formula (I) wherein m=0, a=1, q=3, G=methyl, n is preferably from about 1500 to about 1700, more preferably about 1600; and L is $—N(CH_3)_2$ or $—NH_2$, more preferably $—NH_2$. Other aminosilicones can include those corresponding to formula (I) wherein m=0, a=1, q=3, G=methyl, n is preferably from about 400 to about 600, more preferably about 500; and L is $—N(CH_3)_2$ or $—NH_2$, more preferably $—NH_2$. These aminosilicones can be called as terminal aminosilicones, as one or both ends of the silicone chain are terminated by nitrogen containing group.

An exemplary aminosilicone corresponding to formula (I) is the polymer known as "trimethylsilylamodimethicone", which is shown below in formula (II):

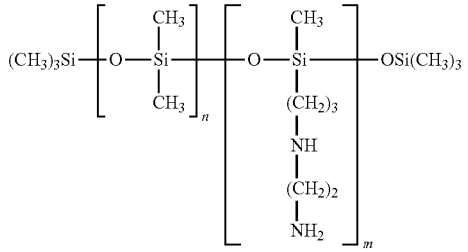

(II)

wherein n is a number from 1 to 1,999 and m is a number from 1 to 1,999.

The silicone may also be a terminal aminosilicone. "Terminal aminosilicone" as defined herein means a silicone polymer comprising one or more amino groups at one or both ends of the silicone backbone. In one aspect, the hydrophobic conditioning agent consists of only terminal aminosilicones.

In one aspect, the amino group at the at least one terminus of the silicone backbone of the terminal aminosilicone is selected from the group consisting of: primary amines, secondary amines and tertiary amines. The terminal aminosilicone may conform to Formula III:

$$(R_1)_aG_{(3-a)}\text{-Si}—(—OSiG_2)_n\text{-O-}SiG_{(3-a)}(R_1)_a \quad III$$

wherein G is hydrogen, phenyl, hydroxy, or $C_1$-$C_8$ alkyl, preferably methyl; a is an integer having a value from 1 to 3, or preferably is 1; n is a number from 0 to 1,999; $R_1$ is a monovalent radical conforming to the general formula $C_qH_{2q}L$, wherein q is an integer having a value from 2 to 8 and L comprises at least one amine group. Preferably L is selected from the following groups: $—N(R_2)CH_2—CH_2—N(R_2)_2$; $—N(R_2)_2$; $—N^+(R_2)_3A^-$; $—N(R_2)CH_2—CH_2—N^+R_2H_2A^-$; wherein $R_2$ is hydrogen, phenyl, benzyl, or a saturated hydrocarbon radical; A is a halide ion. In an aspect, $R_2$ is an alkyl radical having from 1 to 20 carbon atoms, or from 2 to 18 carbon atoms, or from 4 to 12 carbon atoms.

A suitable terminal aminosilicone corresponding to Formula III has a=1, q=3, G=methyl, n is from about 1000 to about 2500, alternatively from about 1500 to about 1700; and L is $—N(CH_3)_2$. In an aspect, $R_2$ is an alkyl radical having from 1 to 20 carbon atoms, or from 2 to 18 carbon atoms, or from 4 to 12 carbon atoms. In an aspect, the terminal aminosilicone is selected from the group consisting of bis-aminomethyl dimethicone, bis-aminoethyl dimethicone, bis-aminopropyl dimethicone, bis-aminobutyl dimethicone, and mixtures thereof.

Suitable silicones further include aminopropyl terminated polydimethylsiloxane (e.g. having a viscosity of 4,000-6,000 cSt (4-6 Pa·s); available under the tradename DMS-A35 from Gelest, Inc.), polydimethylsiloxane, trimethylsiloxy terminated (e.g. having a viscosity of 5,000 cSt (5 Pa·s); available under the tradename DMS-T35 from Gelest, Inc.), polydimethylsiloxane, trimethylsiloxy terminated (e.g. having a viscosity of 1,000 cSt (1 Pa·s); available under the tradename DMS-T31 from Gelest, Inc.), aminopropyl terminated polydimethylsiloxane (e.g. having a viscosity of 900-1,100 cSt (0.9-1.1 Pa·s); available under the tradename DMS-A31 from Gelest, Inc.), polydimethylsiloxane, trimethylsiloxy terminated (e.g. having a viscosity of 50 cSt (0.05 Pa·s); available under the tradename DMS-T15 from Gelest, Inc), aminopropyl terminated polydimethylsiloxane (e.g. having a viscosity of 50-60 cSt (0.05-0.06 Pa·s); available under the tradename DMS-A15 from Gelest, Inc.), bis-aminopropyl dimethicone (e.g. having a viscosity of 10,220 cSt (10.2 Pa·s); available from Momentive Performance Materials Inc.), and mixtures thereof.

The silicone can be dimethyl, methyl (3-aminopropyl) siloxane, trimethylsiloxy-terminated, CAS-No. 99363-37-8, having the structure:

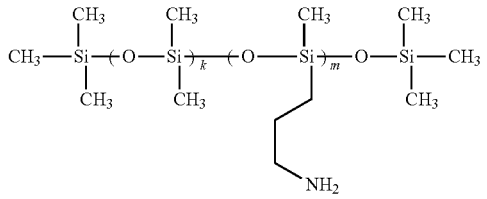

wherein k=1 to 1,999 and m=1 to 1,999.

Alkyl Siloxane Polymer

Suitable conditioning agents as benefit agents of the hydrophobic coating further include alkyl siloxane polymers, as described in detail in US 2011/0243874 A1, US 2011/0243875 A1, US 2011/0240065 A1, US 2011/0243878A1, US 2011/0243871 A1, and US 2011/0243876 A1.

Cationic Organopolysiloxanes

Suitable conditioning agents as benefit agents of the hydrophobic coating further include cationic organopolysiloxanes, as described in detail in US 2014/0030206 A1, WO 2014/018985 A1, WO 2014/018986 A1, WO 2014/018987 A1, WO 2014/018988 A1, and WO 2014/018989 A1.

Organic Conditioning Oils

The hydrophobic conditioning agent of the compositions of the present invention may also comprise at least one organic conditioning oil as the conditioning agent, either alone or in combination with other conditioning agents, such as the silicones. Suitable organic conditioning oils include hydrocarbon oils, polyolefins, fatty esters, metathesized unsaturated polyol esters, or silane-modified oils.

Hydrocarbon Oils

Suitable organic conditioning oils for use as conditioning agents in the compositions of the present invention include, but are not limited to, hydrocarbon oils having at least about 10 carbon atoms, such as cyclic hydrocarbons, straight chain aliphatic hydrocarbons (saturated or unsaturated), and branched chain aliphatic hydrocarbons (saturated or unsaturated), including polymers and mixtures thereof. Straight chain hydrocarbon oils preferably are from about $C_{12}$ to about $C_{22}$.

Specific non-limiting examples of these hydrocarbon oils include paraffin oil, mineral oil, saturated and unsaturated dodecane, saturated and unsaturated tridecane, saturated and unsaturated tetradecane, saturated and unsaturated pentadecane, saturated and unsaturated hexadecane, polybutene, polyisobutylene, polydecene, and mixtures thereof. Branched-chain isomers of these compounds, as well as of higher chain length hydrocarbons, can also be used, examples of which include highly branched, saturated or unsaturated, alkanes such as the permethyl-substituted isomers, e.g., the permethyl-substituted isomers of hexadecane and eicosane, such as 2, 2, 4, 4, 6, 6, 8, 8-dimethyl-10-methylundecane and 2, 2, 4, 4, 6, 6-dimethyl-8-methylnonane, available from Permethyl Corporation. Hydrocarbon polymers such as polybutene and polydecene. A preferred hydrocarbon polymer is polybutene, such as the copolymer of isobutylene and butene. A commercially available material of this type is L-14 polybutene from Amoco Chemical Corporation. Another preferred hydrocarbon polymer is polyisobutylene, a non-limiting example being polyisobutylene having a number average molecular weight of 1,000 and commercially available from EVONIK Industries AG under the trade name REWOPAL PIB 1000.

Polyolefins

Organic conditioning oils for use in the compositions of the present invention can also include liquid polyolefins, liquid poly-α-olefins, hydrogenated liquid poly-α-olefins, and the like. Polyolefins for use herein are prepared by polymerization of $C_4$ to about $C_{14}$ olefenic monomers.

Non-limiting examples of olefenic monomers for use in preparing the polyolefin liquids herein include ethylene, propylene, butene (including isobutene), pentene, hexene, octene, decene, dodecene, tetradecene, branched chain isomers such as 4-methyl-1-pentene, and mixtures thereof. Also suitable for preparing the polyolefin liquids are olefin-containing refinery feedstocks or effluents. Hydrogenated α-olefin monomers include, but are not limited to: 1-hexene to 1-hexadecenes, 1-octene to 1-tetradecene, and mixtures thereof.

Fatty Esters

Other suitable organic conditioning oils for use as conditioning agents in the compositions of the present invention include, but are not limited to, fatty esters having at least 10 carbon atoms. These fatty esters include esters with hydrocarbyl chains derived from fatty acids or alcohols (e.g. mono-esters, polyhydric alcohol esters, and di- and tri-carboxylic acid esters). The hydrocarbyl radicals of the fatty esters hereof may include or have covalently bonded thereto other compatible functionalities, such as amides and alkoxy moieties (e.g., ethoxy or ether linkages, etc.).

Specific examples of fatty esters include, but are not limited to: isopropyl isostearate, hexyl laurate, isohexyl laurate, isohexyl palmitate, isopropyl palmitate, decyl oleate, isodecyl oleate, hexadecyl stearate, decyl stearate, isopropyl isostearate, dihexyldecyl adipate, lauryl lactate, myristyl lactate, cetyl lactate, oleyl stearate, oleyl oleate, oleyl myristate, lauryl acetate, cetyl propionate, and oleyl adipate.

Other fatty esters suitable for use in the compositions of the present invention are mono-carboxylic acid esters of the general formula R'COOR, wherein R' and R are alkyl or alkenyl radicals, and the sum of carbon atoms in R and R is at least 10, preferably at least 22.

Still other fatty esters suitable for use in the compositions of the present invention are di- and tri-alkyl and alkenyl esters of carboxylic acids, such as esters of $C_4$ to $C_8$ dicarboxylic acids (e.g. $C_1$ to $C_{22}$ esters, preferably $C_1$ to $C_6$, of succinic acid, glutaric acid, and adipic acid). Specific non-limiting examples of di- and tri-alkyl and alkenyl esters of carboxylic acids include isocetyl stearyol stearate, diisopropyl adipate, and tristearyl citrate.

Other fatty esters suitable for use in the compositions of the present invention are those known as polyhydric alcohol esters. Such polyhydric alcohol esters include alkylene glycol esters, such as ethylene glycol mono and di-fatty acids, diethylene glycol mono- and di-fatty acid esters, polyethylene glycol mono- and di-fatty acid esters, propylene glycol mono- and di-fatty acid esters, polypropylene glycol monooleate, polypropylene glycol 2000 monostearate, ethoxylated propylene glycol monostearate, glyceryl mono- and di-fatty acid esters, polyglycerol poly-fatty acid esters, ethoxylated glyceryl monostearate, 1,3-butylene glycol monostearate, 1,3-butylene glycol distearate, polyoxyethylene polyol fatty acid ester, sorbitan fatty acid esters, and polyoxyethylene sorbitan fatty acid esters.

Still other fatty esters suitable for use in the compositions of the present invention are glycerides, including, but not limited to, mono-, di-, and tri-glycerides, preferably di- and tri-glycerides, more preferably triglycerides. For use in the compositions described herein, the glycerides are preferably the mono-, di-, and tri-esters of glycerol and long chain carboxylic acids, such as $C_{10}$ to $C_{22}$ carboxylic acids. A variety of these types of materials can be obtained from vegetable and animal fats and oils, such as castor oil, safflower oil, cottonseed oil, corn oil, olive oil, cod liver oil, almond oil, avocado oil, palm oil, sesame oil, lanolin and soybean oil. Synthetic oils include, but are not limited to, triolein and tristearin glyceryl dilaurate.

Other fatty esters suitable for use in the compositions of the present invention are water insoluble synthetic fatty esters. Some preferred synthetic esters conform to the general Formula (IX):

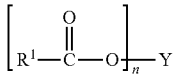

wherein $R^1$ is a $C_7$ to $C_9$ alkyl, alkenyl, hydroxyalkyl or hydroxyalkenyl group, preferably a saturated alkyl group, more preferably a saturated, linear, alkyl group; n is a positive integer having a value from 2 to 4, preferably 3; and Y is an alkyl, alkenyl, hydroxy or carboxy substituted alkyl or alkenyl, having from about 2 to about 20 carbon atoms, preferably from about 3 to about 14 carbon atoms. Other preferred synthetic esters conform to the general Formula (X):

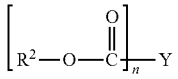

wherein $R^2$ is a $C_8$ to $C_{10}$ alkyl, alkenyl, hydroxyalkyl or hydroxyalkenyl group; preferably a saturated alkyl group, more preferably a saturated, linear, alkyl group; n and Y are as defined above in Formula (X).

Specific non-limiting examples of suitable synthetic fatty esters for use in the compositions of the present invention include: P-43 ($C_8$-$C_{10}$ triester of trimethylolpropane), MCP-684 (tetraester of 3,3 diethanol-1,5 pentadiol), MCP 121 ($C_8$-$C_{10}$ diester of adipic acid), all of which are available from Mobil Chemical Company.

Metathesized Unsaturated Polyol Esters

Other suitable organic conditioning oils as conditioning agents include metathesized unsaturated polyol esters. Exemplary metathesized unsaturated polyol esters and their starting materials are set forth in US 2009/0220443 A1. A metathesized unsaturated polyol ester refers to the product obtained when one or more unsaturated polyol ester ingredient(s) are subjected to a metathesis reaction. Metathesis is a catalytic reaction that involves the interchange of alkylidene units among compounds containing one or more double bonds (i.e., olefinic compounds) via the formation and cleavage of the carbon-carbon double bonds. Metathesis may occur between two of the same molecules (often referred to as self-metathesis) and/or it may occur between two different molecules (often referred to as cross-metathesis).

Silane-Modified Oils

Other suitable organic conditioning oils as conditioning agents include silane-modified oils. In general, suitable silane-modified oils comprise a hydrocarbon chain selected from the group consisting of saturated oil, unsaturated oil, and mixtures thereof; and a hydrolysable silyl group covalently bonded to the hydrocarbon chain. Suitable silane-modified oils are described in detail in U.S. Application Ser. No. 61/821,818, filed May 10, 2013.

Other Conditioning Agents

Also suitable for use in the compositions herein are the conditioning agents described by the Procter & Gamble Company in U.S. Pat. Nos. 5,674,478, and 5,750,122. Also suitable for use herein are those conditioning agents described in U.S. Pat. No. 4,529,586 (Clairol), U.S. Pat. No. 4,507,280 (Clairol), U.S. Pat. No. 4,663,158 (Clairol), U.S. Pat. No. 4,197,865 (L'Oreal), U.S. Pat. No. 4,217,914 (L'Oreal), U.S. Pat. No. 4,381,919 (L'Oreal), and U.S. Pat. No. 4,422,853 (L'Oreal).

Mean Particle Size of Hydrophobic Conditioning Agent

The hydrophobic conditioning agent is disposed within the carrier material as substantially discrete particles having a mean particle size of from about 1 μm to about 500 μm. Without being bound by theory, it is believed that the relatively large mean particle size of hydrophobic conditioning agent facilitates deposition of the hydrophobic conditioning agent on the target surface. The desired mean particle size of the hydrophobic conditioning agent can be "set" in the carrier material of the non-porous dissolvable solid structure upon solidification of a melt composition which comprises a mixture of liquefied hydrophobic conditioning agent and liquefied carrier material. In making the consumer product composition, the carrier material is liquefied prior to mixing the hydrophobic conditioning agent within it, for example by heating the carrier material to a temperature above its melting point (e.g. 70° C.).

The mean particle size of the hydrophobic conditioning agent disposed in the carrier material of the non-porous dissolvable solid structure of the consumer product composition is from about 1 μm to about 500 μm. The mean particle size of the hydrophobic conditioning agent disposed in the non-porous dissolvable solid structure is determined according to the MEAN PARTICLE SIZE OF HYDROPHOBIC CONDITIONING AGENT TEST METHOD described hereinbelow. As used herein, the mean particle size of the hydrophobic conditioning agent reflects the mean particle diameter as measured according to the MEAN PARTICLE SIZE OF HYDROPHOBIC CONDITIONING AGENT TEST METHOD.

The optimal mean particle size of the hydrophobic conditioning agent may depend upon the intended use of the consumer product composition. For instance, a fabric softening product composition for conditioning fabrics in a laundry process will preferably contain a hydrophobic conditioning agent having a mean particle size of from about 1 μm to about 500 μm, preferably 2 μm to 500 μm, more preferably from about 2 μm to about 120 μm, more preferably from about 2 μm to about 70 μm, more preferably from about 5 μm to about 25 μm. Since the consumer product composition is in a solid, non-porous form, the particle size of the hydrophobic conditioning agent will generally remain constant during packaging, shipping and storage of the consumer product composition.

Particulate Spacer Material

The consumer product composition further comprises a particulate spacer material disposed (and, e.g., dispersed) within the carrier material of the non-porous dissolvable solid structure. The particulate spacer material is generally in the form of particles and has a mean particle size of from about 55 microns to about 750 microns, preferably from about 75 microns to about 650 microns, preferably from about 95 microns to about 600 microns, and preferably from about 100 microns to about 250 microns. The mean particle size of the particulate spacer material is determined according to the MEAN PARTICLE SIZE OF SPACER AND SPACER POLYDISPERSITY TEST METHOD hereinbelow.

If the mean particle size of the particulate spacer material is too small or too large, the particulate spacer material can negatively impact the solubility of the consumer product composition, especially when the consumer product composition is in the form of a plurality of beads, thereby affecting the usefulness of the consumer product composition and increasing the possibility that the consumer product composition may stain treated fabrics.

In one aspect, the particulate spacer material has a mean particle size that is greater than the mean particle size of the hydrophobic conditioning agent. This allows the particulate spacer material to provide sufficient spacing between the surface of the non-porous dissolvable solid structure and the surface of the fibrous substrate treated with the aqueous treatment liquor formed by dissolving the consumer product composition of the present invention. A ratio of the mean particle size of the particulate spacer material to the mean particle size of the hydrophobic conditioning agent is at least about 5:1, preferably at least about 10:1, preferably at least about 20:1, preferably at least about 30:1, and preferably at least about 50:1.

The particulate spacer material either (i) is water-insoluble or (ii) a ratio of dissolution rate of said carrier material to dissolution rate of said particulate spacer material is at least about 2. The dissolution rate of the particulate spacer material (and of the carrier material) is determined according to the DISSOLUTION RATE TEST METHOD hereinbelow.

In one aspect, the particulate spacer material is water-insoluble (at 25° C.). Such a water-insoluble particulate spacer material will therefore have a dissolution rate of about 0 $\mu m\ s^{-1}$ according to the DISSOLUTION RATE TEST METHOD hereinbelow.

In one aspect, the particulate spacer material will have a dissolution rate such that a ratio of dissolution rate of the carrier material to the dissolution rate of the particulate spacer material will be at least about 2, preferably from about 2 to about 200, preferably from about 2 to about 100, preferably from about 2 to about 25, and preferably from about 3 to about 5. The particulate spacer material will preferably have a dissolution rate of from about $-0.8\ \mu m\ s^{-1}$ to about $-0.01\ \mu m\ s^{-1}$.

The non-porous dissolvable solid structure of the consumer product composition of the present invention comprises a volume fraction of the particulate spacer material of from about 0.05 to about 0.5, preferably from about 0.1 to about 0.5, preferably from about 0.15 to about 0.45, preferably from about 0.2 to about 0.45. The "volume fraction" of particulate spacer material present in the non-porous dissolvable solid structure is the volume of the spacer material divided by the total volume of the non-porous dissolvable solid structure. The volume of the particulate spacer material (e.g. in $cm^3$) can be determined by dividing the weight of the particulate spacer material in the non-porous dissolvable solid structure (e.g. in grams) by the density of the particulate spacer material (e.g. in grams per $cm^3$). The total volume of the non-porous dissolvable solid structure can be determined by adding together the volume of all the components in the non-porous dissolvable solid structure (e.g. the volume of the particulate spacer material, plus the volume of the carrier material, plus the volume of the hydrophobic conditioning agent, plus the volume of any other components present). The volume of the carrier material (in $cm^3$), or other component, in the non-porous dissolvable solid structure can be determined by dividing the weight of the carrier material, or other component, in the non-porous dissolvable solid structure (e.g. in grams), by the density of the carrier material (e.g. in grams per $cm^3$), or other component, respectively.

The consumer product composition will typically comprise from about 5% to about 50%, preferably from about 10% to about 45%, and preferably from about 20% to about 40%, by weight of the consumer product composition, of particulate spacer material.

The hydrophobic conditioning agent and particulate spacer material are preferably not premixed before combining each with said carrier material.

The particulate spacer material can have a variety of shapes, such as spherical, cube, granule, oblong, crystalline, and the like. The particulate spacer material can also be a colored material, preferably having a color different from the carrier material such that a visual contrast is obtained between the carrier material and the particulate spacer material.

The particulate spacer material is a solid at 25° C., and preferably a solid at 70° C.

The particulate spacer material may encompass materials that have a variety of different densities. In one aspect, the particulate spacer material can have a density greater than 1 gram per $cm^3$. In one aspect, the particulate spacer material can have a density less than 1 gram per $cm^3$.

The particulate spacer material can be hollow or solid throughout the material. In one aspect, the particulate spacer material is hollow. In one aspect, the particulate spacer material is solid throughout the material.

The particulate spacer material can be an organic or an inorganic particulate material. In one aspect, the particulate spacer material is an inorganic particulate spacer material. In one aspect, the particulate spacer material is an organic particulate spacer material.

The particulate spacer material can be selected from the group consisting of glass microspheres, ceramic microspheres, polyalkylene microspheres, alkali metal borates, and combinations thereof. Suitable glass microspheres include soda lime glass microspheres, hollow glass microspheres, borosilicate solid glass microspheres, and the like, and mixtures thereof. Suitable polyalkylene microspheres include polyethylene microspheres, polypropylene microspheres, and the like, and mixtures thereof. Suitable alkali metal borates include sodium borate, sodium tetraborate, disodium tetraborate, potassium tetraborate, and the like, and mixtures thereof.

Non-limiting examples of particulate spacer materials include Soda Lime Glass Microspheres (available from Cospheric LLC (Santa Barbara, Calif., USA) under the tradenames SLGMS-2.5 (500-600 μm), (180-212 μm), or (90-106 μm)), Polyethylene Microspheres (available from Cospheric LLC (Santa Barbara, Calif., USA) under the tradename UVPMS-BG-1.00 (180-212 μm)), and Borax powder (5 mol. available from Univar USA Inc (Cincinnati, US) Lot: 3G2).

FIG. 1 shows a magnified cross-sectional view of a consumer product composition of the present invention, according to Example 3, comprising a non-porous dissolvable structure comprising a carrier material (PEG 8000), and a hydrophobic conditioning agent (terminal aminosilicone) and particulate spacer material (soda lime glass microspheres) disposed in the carrier material. The particles of particulate spacer material (shown as white particles) are significantly larger in size compared to the particles of hydrophobic conditioning agent (shown as black particles), both being dispersed in the carrier material (shown in gray color).

Figure 2:
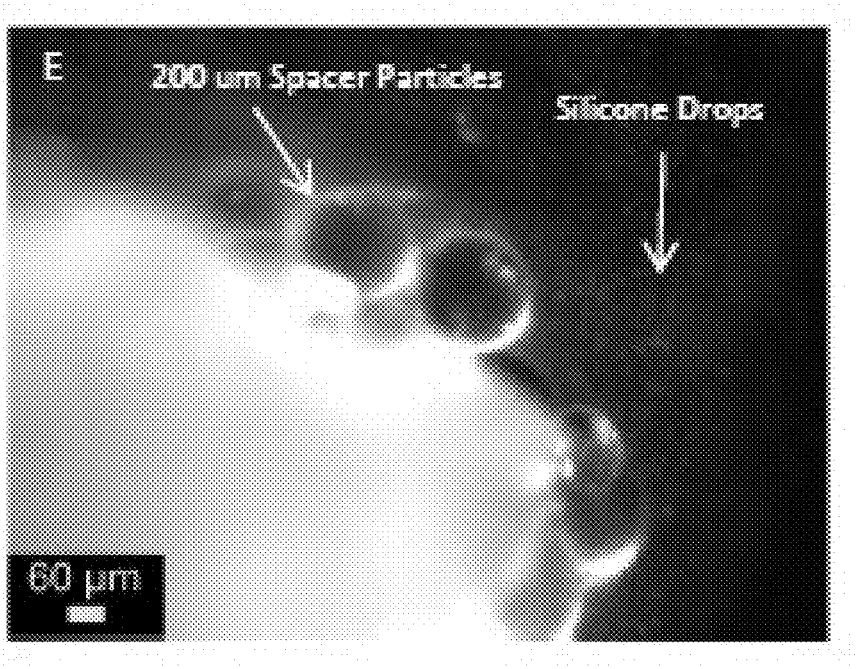
FIG. 2 is a micrograph of a consumer product composition of the present invention being dissolved in water to form an aqueous treatment liquor.

The spacing provided by the particulate spacer material from the surface of the non-porous dissolvable solid structure is illustrated in FIG. 2. As the non-porous dissolvable solid structure dissolves, the particulate spacer material protrudes from the surface of the non-porous dissolvable solid structure and therefore provides a gap between that surface and the surface of any fibrous structure in the aqueous treatment liquor. This gap helps to minimize the possibility of undesirable staining of the fibrous structure when treated with the consumer product compositions of the present invention.

Filler Materials

The consumer product composition can optionally further comprise filler materials, which are materials (other than hydrophobic conditioning agents and particulate spacer materials) that are not miscible in the, e.g. liquefied, carrier material and have a mean particle size less than or greater than the mean particle size of the particulate spacer material and/or have a dissolution rate similar to that of the carrier material and significantly less than the particulate spacer material. Preferred filler materials include inorganic chloride salts (e.g. sodium chloride), carbohydrates (such as sugars, starches, celluloses, and the like), clays, metal oxides (e.g. $TiO_2$), zeolites, urea, and the like.

The filler material can be dispersed within the carrier material.

The consumer product composition preferably comprises less than about 5%, preferably less than about 3%, preferably less than about 1%, by weight of the consumer product composition, of water. The consumer product composition is preferably free of water (i.e. anhydrous).

The consumer product composition preferably comprises less than about 5%, preferably less than about 3%, preferably less than about 1%, by weight of the consumer product composition, of detersive surfactant and/or cleansing surfactant. The consumer product composition is preferably free of detersive surfactant and/or cleansing surfactant.

Loading

The consumer product composition of the present invention typically comprises hydrophobic conditioning agent in an amount of at least about 1%, preferably at least about 5%, preferably at least about 10%, preferably at least about 12%, preferably at least about 15%, by weight of the consumer product composition.

The amount of hydrophobic conditioning agent disposed in the carrier material in the non-porous dissolvable solid substrate can tend to have an affect on the mean particle size of the hydrophobic conditioning agent in the consumer product composition. In general, the greater the amount of hydrophobic conditioning agent in the non-porous dissolvable solid structure, the greater the mean particle size of the hydrophobic conditioning agent disposed within the carrier material of the non-porous dissolvable solid structure of the consumer product composition.

The level of hydrophobic conditioning agent in the consumer product composition determines the amount of consumer product required at point of use by the consumer to derive the desired degree of conditioning benefit. Specifically, at higher levels of loading, less consumer product composition is required per use.

Form of Consumer Product Composition

The consumer product composition of the present invention is preferably provided in the form of a plurality of beads. The size of the beads is tailored so that they are large enough to be easily handled yet small enough to dissolve in the context of the use environment. For example, use of the consumer product in a clothes washing machine may require that the carrier material of the product composition dissolve in the course of a few minutes and in the context of a variety of water temperatures. Separately, use in a personal care context may require that the carrier material of the product dissolve in a fewer number of minutes when wetted and rubbed between the palms of the hands.

The physical size of the beads may be expressed as the average of the maximum cross-sectional dimension of the plurality of beads.

The maximum cross-sectional dimension of any single bead within the plurality of beads is taken as the length of the longest linear dimension that can be inscribed entirely within the outer perimeter of the single bead. The average maximum cross-sectional dimension of the plurality of beads may be taken as the average of the longest linear dimension that can be inscribed entirely within the single bead, across all the beads within the plurality of beads. It would be appreciated by one of ordinary skill in the art that this average may also be reflected by taking the average across a statistically relevant sample of beads from the plurality of beads.

The plurality of beads preferably have an average maximum cross-sectional dimension of from about 0.05 to about 50 mm, preferably from about 0.3 to about 10 mm, preferably from about 0.5 to about 5 mm, preferably from about 1 to about 3 mm. It is recognized that the average maximum cross-sectional dimension of the plurality of beads will be greater (preferably at least two times greater) than the mean particle size of the hydrophobic conditioning agent within the carrier material of the non-porous dissolvable solid structure.

The beads of the consumer product composition may take any shape. For example the shape may be everywhere convex (e.g. a sphere) or may have areas of convexity. The shape may include any basic three-dimensional shape, such as spheres, hemispheres, oblate spheres, spheroids, discs, plates, cones, truncated cones, prisms, cylinders, pyramids, noodles, rectangles, doughnuts, toroids, and the like. The shape may be formed to resemble recognizable shapes such as a heart, star, shamrock, pretzel, "smiley face" and the like. The shape may include recognizable imagery such as icons and logos including logos representative of product brands. The shapes may be uniform shapes, a combination of different shapes, or generally random shapes (such as prills).

The physical shape of the bead can be expressed in terms of an aspect ratio of the bead. The aspect ratio of a bead is the ratio of maximum cross-sectional dimension of the bead to the longest dimension which is perpendicular to the maximum cross-sectional dimension and entirely within the outer perimeter of the bead. The aspect ratio of a single bead, or the average aspect ratio of a plurality of beads, is preferably from about 1:1 to about 1000:1, preferably from about 1:1 to about 100:1, preferably from about 1:1 to about 10:1, preferably from about 1:1 to about 2:1.

Process of Making the Consumer Product Composition

In general, a process of making the consumer product composition of the present invention comprising a non-porous dissolvable solid structure can include pastillation processes, prilling processes, molding processes, extrusion processes, and the like.

Such processes of making a consumer product composition comprising a non-porous dissolvable solid structure typically comprise the steps of

- providing a carrier material (preferably having a melting point of greater than 25° C.);
- heating the carrier material (preferably to a temperature greater than the melting point of the carrier material),
- mixing a hydrophobic conditioning agent and particulate spacer material with the heated carrier material to form a melt composition; and
- cooling the melt composition (preferably to a temperature below the melting point of the carrier material) to form the non-porous dissolvable solid structure of the consumer product composition. The cooling step should be performed in sufficient time so as to prevent the particulate spacer material from becoming non-dispersed within the carrier material (e.g. prevent agglomeration of the spacer material in the carrier). It is preferred that the hydrophobic conditioning agent and the particulate spacer material are added separately to the heated carrier material.

A pastillation process for making the consumer product composition of the present invention generally comprises the steps recited above, wherein the step of cooling the melt composition comprises dispensing the melt composition drop-wise onto a cooling surface (i.e. a surface that is cooled relative to ambient temperature (e.g. 25° C.)).

A prilling process for making the consumer product composition of the present invention generally comprises the steps recited above, wherein the step of cooling the melt composition comprises dispensing the melt composition drop-wise into a cooling atmosphere (i.e. a controlled atmosphere in which the air is cooled relative ambient temperature (e.g. 25° C.)).

A molding process for making the consumer product composition of the present invention generally comprises the steps recited above, wherein the step of cooling the melt composition comprises dispensing the melt composition into a mold and further comprising the step of cooling the melt composition in the mold to form the non-porous dissolvable solid structure of the consumer product composition prior to releasing the consumer product composition from the mold.

A suitable process for making a consumer product composition of the present invention, preferably in the form of a plurality of beads, is described in U.S. Pat. No. 7,867,986.

The amount of shear imparted to the melt composition during the process of making the consumer product composition can have an impact on the mean particle size of the hydrophobic conditioning agent in the resulting consumer product composition. E.g., the mean particle size of the hydrophobic conditioning agent tends to increase as the shear rate is decreased.

Viscosity Ratio

In certain aspects, achieving the relatively large mean particle size of the hydrophobic conditioning agent in the non-porous dissolvable solid structure of the consumer product composition can be impacted by the relative viscosities of the liquefied carrier material composition and the liquid/liquefied hydrophobic conditioning agent (e.g. in the melt composition). It is believed that the higher the viscosity of the liquefied carrier material, the greater the ability of the liquefied carrier material to transfer energy to the dispersed hydrophobic conditioning agent, thereby the greater the tendency for the hydrophobic conditioning agent to form smaller particles. Further, it is believed that the higher the viscosity of the hydrophobic benefit agent (e.g. during manufacture), the greater the ability of the hydrophobic conditioning agent to resist being broken up, thereby the greater the tendency for the hydrophobic conditioning agent to form larger particles. As such, at elevated temperatures in which the carrier material and hydrophobic conditioning agent are both liquid, the viscosity ratio of the viscosity of the hydrophobic conditioning agent to the viscosity of the liquefied carrier material preferably falls within certain ranges to facilitate formation of relatively large mean particle size of hydrophobic conditioning agent in the non-porous dissolvable solid structure of the consumer product composition.

Preferably the ratio of the viscosity of said hydrophobic conditioning agent at 70° C. to the viscosity of said carrier material at 70° C. is from about 1000:1 to about 1:1000, preferably from about 100:1 to about 1:100, preferably from about 10:1 to about 1:10, preferably from about 5:1 to about 1:5.

Method of Forming Aqueous Treatment Liquor

The present invention further encompasses a method of forming an aqueous treatment liquor by dissolving the consumer product composition of the present invention. The aqueous treatment liquor can be, for example, an aqueous laundry treatment liquor formed in a washing machine or hand-washing vessel.

In most applications, the size of the particles of hydrophobic conditioning agent in the non-porous dissolvable solid structure is maintained as the non-porous dissolvable solid structure dissolves and the particles of hydrophobic conditioning agent are released during use. Not wishing to be bound by theory, it is believed that the viscosity of the aqueous treatment liquor relative to the hydrophobic conditioning agent is such that the modest shear in many environments (such as a washing machine) are insufficient to break the particles into yet smaller particles, as long as the viscosity of the hydrophobic conditioning agent is sufficiently high.

The method generally comprises the steps of providing a consumer product composition of the present invention, providing an aqueous solution, and dissolving the consumer product composition in the aqueous solution. As the method steps are carried out, the dissolvable structure of the consumer product composition begins to dissolve in the aqueous solution. As the dissolvable structure dissolves away, the particles of hydrophobic conditioning agent disposed within the carrier material of the non-porous dissolvable solid structure of the consumer product composition are dispersed into the aqueous solution, and tend to maintain their mean particle size in the formed aqueous treatment liquor. It is the resulting relatively large particles of hydrophobic conditioning agent in the aqueous treatment liquor that result in significant improvements in providing the desired benefits to the consumer of the consumer product composition, such as fabric softening.

The release of particles of hydrophobic conditioning agent from the dissolvable solid structure of the consumer product composition into the aqueous solution is illustrated in the micrographs of FIG. 2. As shown in FIG. 2, many particles of hydrophobic conditioning agent are dispersed into aqueous solution from the consumer product composition and tend to maintain their mean particle size in aqueous solution as the particles drift away from the dissolving consumer product composition. The particles also do not coalesce or aggregate under these flow conditions. As such, the "setting" of the appropriate mean particle size of hydrophobic conditioning agent within the carrier material of the non-porous dissolvable solid structure of the consumer product composition of the present invention is important with respect ultimately forming an aqueous treatment liquor having the desired particle size of hydrophobic conditioning agent to facilitate enhanced deposition and improved conditioning of the surfaces treated. As further shown in FIG. 2, and as the non-porous dissolvable solid structure dissolves, the particulate spacer material (which has a mean particle size of about 200 μm) can maintain a gap between the surface of the non-porous dissolvable solid structure of the composition and the surfaces of fibrous substrates that are treated with the aqueous treatment liquor.

In forming the aqueous treatment liquor by dissolving the dissolvable structure of the consumer product composition, the method preferably further comprises the step of agitating the aqueous treatment liquor. The agitation of the aqueous treatment liquor can be important to further facilitate contact between the target surface and the relatively large particles of hydrophobic conditioning agent in the aqueous treatment liquor. The agitation can be accomplished by mechanically manipulating (e.g. by machine or by hand) the aqueous treatment liquor (e.g. agitation), preferably during dissolution of the non-porous dissolvable solid structure.

In one aspect of the present invention, a method of treating a surface, preferably a fabric, comprises the steps of:

providing a consumer product composition according to the present invention;

providing an aqueous solution;

dissolving the consumer product composition in the aqueous solution to form an aqueous treatment liquor; and contacting the surface with the aqueous treatment liquor.

Preferably the fabric is contacted with the aqueous treatment liquor during a wash cycle and/or rinse cycle, preferably during a wash cycle, of a laundry process.

Test Methods

The following test methods are conducted on samples that have been conditioned, for a minimum of 24 hours prior to testing, in a conditioned room at a temperature of 23° C.±2.0° C. and a relative humidity of 45%±10%. Except where noted, all tests are conducted under the same environmental conditions and in such conditioned room. Except where noted, all quantities are given on a weight basis. Except where noted all water used is laboratory-grade deionized (DI) water. Except where noted, at least three samples are measured for any given material being tested and the results from those three (or more) replicates are averaged to give the final reported value for that material, for that test.

Viscosity Test Method

The viscosity of a component of the consumer product composition, e.g. a hydrophobic conditioning agent or carrier material, is determined as follows.

For a given component, the viscosity reported is the viscosity value as measured by the following method, which generally represents the infinite-shear viscosity (or infinite-rate viscosity) of the component. Viscosity measurements are made with a TA Discovery HR-2 Hybrid Rheometer (TA Instruments, New Castle, Del., U.S.A.), and accompanying TRIOS software version 3.0.2.3156. The instrument is outfitted with a 40 mm stainless steel Parallel Plate (TA Instruments, cat. #511400.901), Peltier plate (TA Instruments cat. #533230.901), and Solvent Trap Cover (TA Instruments, cat. #511400.901). The calibration is done in accordance with manufacturer recommendations. A refrigerated, circulating water bath set to 25° C. is attached to the Peltier plate. The Peltier Plate temperature is set to 70° C. The temperature is monitored within the Control Panel until the instrument reaches the set temperature, then an additional 5 minutes is allowed to elapse to ensure equilibration before loading sample material onto the Peltier plate.

To load a liquid material (e.g. a hydrophobic conditioning agent), a transfer pipette is used to transfer 2 ml of the liquid material onto the center surface of the Peltier plate. To load a non-liquid material (e.g. a carrier material), 2 grams of non-liquid material is added onto the center surface of the Peltier plate, and the sample is allowed to completely liquefy. If the loaded sample liquid contains visible bubbles, a period of 10 minutes is waited to allow the bubbles to migrate through the sample and burst, or a transfer pipette can be used to extract the bubbles. If bubbles still remain, then the sample is removed from the plate, the plate is cleaned with isopropanol wipe and the solvent is allowed to evaporate away. The sample loading procedure is then attempted again and repeated until a sample is loaded successfully without containing visible bubbles.

The parallel plate is lowered into position in several stages, with the gap distance initially set at 3000 micrometers (μm). After waiting 60 seconds with the plate at that gap distance, the parallel plate is further lowered into position with the gap distance set at 1500 micrometers. After waiting an additional 60 seconds, the parallel plate is further lowered into position with the gap distance set at 750 micrometers. After waiting a final 60 seconds, the parallel plate is further lowered into position with the gap distance set at 550 micrometers.

After the parallel plate is locked, any excess sample material is removed from the perimeter of the parallel plate using rubber policeman. It is important to ensure that the sample is evenly distributed around the edge of the parallel plate and there is no sample on the side or top of plate. If there is sample material on the side or top of the plate, this excess material is gently removed. The Solvent Trap Cover is carefully applied over the parallel plate, and the parallel plate is lowered into its final position by setting the gap distance to 500 micrometers.

The Instrument Procedures and Settings (IPS) used are as follows:

1) Conditioning Step (pre-condition the sample) under the "Environmental Control" label: "Temperature" is 70° C., "Inherit set point" is not selected, "Soak time" is 0.0 s, "Wait for temperature" is selected; under the "Wait for axial force" label: "Wait for axial force" is not selected; under the "Preshear options" label: "Perform preshear" is selected, "Shear rate is 5.0 $s^{-1}$, "Duration" is 60.0 s, and under the "Advanced" option, the "Motor mode" is Auto; under the "Equilibration" label: "Perform equilibration" is selected, and "Duration" is 120 s.

2) Flow Sweep under the "Environmental Control" label: "Temperature is 70° C., "Inherit set point" is not selected, "Soak time" is 0.0 s, "Wait for temperature" is selected; under the "Test Parameters" label: "Logarithmic sweep" is selected, "Shear rate" is $1.0\times10^{-3}$ to 1000.0 $s^{-1}$ "Points per decade" is 15, "Steady state sensing" is selected, "Max equilibration time" is 45.0 s, "Sample period" is 5.0 s, "% tolerance" is 5.0, "Consecutive within" is 3, "Scaled time average" is not selected; under the "Controlled Rate Advanced" label: "Motor mode" is Auto; under the "Data acquisition" label: "Save point display" is not selected, nor is "Save image" selected; under the "Step termination" label: "Label checking: Enabled" is not selected, nor is "Equilibrium: Enabled" selected.

3) Conditioning End of Test: "Set temperature is selected", "Temperature" is set to 70° C. if running multiple tests, if only running one sample or the last sample, "Temperature" is set to 25° C.; and "Set temperature system idle (only if axial force control is active)" is not selected.

After collecting the data, the data set is opened in the TRIOS software. The limits for the data analysis are set whereby the data points which were collected with an applied rotor torque of less than 1 micro-N·m are discarded, data points which were collected with a measured strain less than 300% are also discarded, and data points which were collected with an applied rotor torque of greater than 20,000 micro-N·m are also discarded.

The remaining data points are analyzed in the following way:

If the relative change (ie variation) in viscosity over the remaining data points is less than 20%, then select the "Analysis" tab from the top tool bar. Select the "Newtonian" option from the "Function" menu. Click the "Start Analysis" button. The viscosity is the "Newtonian Viscosity".

If the relative change in viscosity over the remaining data points equals or exceeds 20%, then select the "Analysis" tab from the top tool bar. Select the "Best Fit Flow (Viscosity vs. Rate)" option from the "Function" menu. Click the "Start Analysis" button. The analysis will show multiple results from different rheology models. The best model used to determine the viscosity is the model with largest $R^2$ value that incorporates an "Infinite-Rate Viscosity" (e.g. Carreau-Yasuda Model, Carreau Model and Cross Model).

The viscosity is the "Infinite-Rate Viscosity" from the best model.

The reported viscosity value of the component measured is the average (mean) viscosity from three independent viscosity measurements (i.e. three replicate sample preparations) and is expressed in units of Pa·s.

Mean Particle Size of Spacer and Spacer Polydispersity Test Method

The mean particle size values and Polydispersity values of the particulate spacer material are determined from measurements conducted with a Malvern MasterSizer 2000 Particle Sizer Instrument (Malvern Instruments Inc., Southborough, Mass., USA) and accompanying MasterSizer 2000 software version 5.1, according to the following test method. The instrument is outfitted with a Dry Powder Feeder (Scirocco Dry Powder Feeder, Malvern Instruments Inc., Southborough, Mass., USA), and Exhaust System (Nilfisk Filtered Vacuum System Model 81, Nilfisk Co., Malvern, Pa.). Additionally, the instrument is supplied with pressurized filtered dry air. The dry air system is pressurized in the range of 50-100 psi (e.g. 345 kPa-690 kPa), comprises an in-line moisture condensation removal system, and delivers air at a rate of approximately 140 L/min. The dry air supplied is filtered to remove particulates within the size range measurable by the particle sizer instrument. The particle sizer instrument system is calibrated in accordance with manufacturer recommendations using Glass Bead Audit Standard for Dry Powder Feeder, calibration only (Malvern Instruments Inc., catalogue #QAS2003).

Samples of spacer particles are stored dry and protected from humidity greater than 50% RH, in tightly sealed containers. Care must be taken to ensure samples do not change (e.g. aggregate) during storage or analysis. Samples are mixed such that the natural particle size distribution is preserved, and care is taken to prevent agglomeration. Samples that are powders should have the appearance of being completely free flowing. Samples that contain lumps or hard agglomerates should be replaced with a new, representative sample of the material that is free of aggregates. One of skill will understand that spacer samples originating from a finished consumer product composition should be extracted such that the harvested sample is in a form consistent with being in the product composition, and substantially free of non-spacer consumer product composition materials (e.g. carrier such as polyethylene glycol PEG). Samples of the spacer particles to be tested are introduced into the Feed Hopper of the Dry Powder Feeder.

The instrument is set up as follows: The Particle Name is set to "Default"; Accessory Name is selected as "Scirocco 2000 (A) Dry Powder Feeder"; the Analysis Model is selected as "General Purpose"; the Sensitivity is set to "Enhanced"; the Particle Refractive Index is set to "1.520"; the Absorption Index is set to "0.1"; the Size Range is set to "0.020 μm" to "2000.000 μm"; the Obscuration is set to "Lower limit 1% Upper limit 10%"; the Measurement Time is set to "5 seconds", the Measurement Snaps is set to "5000", the Background time is set to "10 seconds", The Background Snaps is set to "1000"; the Sample Settings are set to "Vibration Feed Rate 80%"; the Dispersive Air Pressure is set as "2 Bar"; and the Measurement Cycles is selected as "Aliquot 1" with Measurement "1 per aliquot".

The laser is allowed to warm up for at least 20 minutes prior to taking measurements. The dry powder feeder optical cell is installed into the MasterSizer optical bench; the sample tray is installed and securely clamp into place inside the dry powder feeder; the mixer sieve is in place; and the airline is attached at approximately 60 psi (e.g. 414 kPa).

Once set-up is complete, a 2 g sample of the dry test material is introduced into the feed hopper of the dry powder feeder. The gates on feed hopper are adjusted to 5-10 mm and the cover is closed. The analysis is started and the instrument is allowed to run until the measurement is complete. For any given test material, at least 3 replicate samples are analyzed. The dry powder feeder must be cleaned thoroughly between each sample measurement by either brushing or vacuuming to remove any residual sample. The instrument feeder and surroundings areas are carefully examined to determine if loss of sample from the feeder occurred to a degree which may affect the accuracy of the results obtained. In situations where such sample loss occurs, the dry data collected are discarded and the test material is measured following the alternate Wet Feeder procedures specified herein further below.

Distribution metrics such as the Volume-Weighted Median D[v,0.5], and the Span, are calculated automatically by the MasterSizer software for each replicate sample analyzed. For each metric the arithmetic mean is calculated using the values measured from all replicates. For a given test material, the mean of the Volume-Weighted Median D[v,0.5] values is reported as the mean particle size value of the particulate spacer material, expressed in micrometers; and the mean of the Span values is reported as the Polydispersity value of the particulate spacer material, expressed in micrometers.

Spacer samples that were unable to be measured accurately via the Dry Feeder method above due to sample loss from the dry powder feeder or feed hopper (which may occur with some nearly-spherical particles), are subsequently measured while in a fluid suspension via a wet feeder on the instrument. The wet feeder procedure instructions include the dry method instructions specified above amended with the following modifications: For wet feeder measurements the Malvern MasterSizer 2000 Particle Sizer Instrument is equipped with a Hydro 2000SM system (Malvern Hydro 2000SM Model ADA2002, Malvern Instruments Inc., Southborough, Mass., USA). The Hydro system includes a dispersion unit that houses a stirrer, a controller unit which displays the stirrer speed, and a flow cell which is situated in the instrument's optical bench and allows the sample to pass through the analyzer beam.

A test sample is prepared for measurement via the wet feeder procedure by being suspended in a commonly available fluid (such as water or an organic solvent) which is carefully selected such that the fluid chosen is one in which the test particles are insoluble, while also being a commonly available fluid having a refractive index (RI) value that is dissimilar to the RI value of the particles. At no time are the particles to come in contact with a fluid in which they are readily soluble. The spacer particles in the sample are suspended such that the natural particle size distribution is preserved, and care is taken to prevent agglomeration of the particles. If necessary to prevent agglomeration, a small amount of surfactant (less than 1 mL) may be added to the suspension. The dispersion unit of the instrument is filled with the same fluid used to create the sample suspension.

For wet feeder measurements the instrument is set up as follows: The Particle Name is set to "Default"; Accessory Name is selected as "Hydro 20005M"; the Analysis Model is selected as "Single Narrow Mode (spherical)"; the Sensitivity is set to "Enhanced"; the Particle Refractive Index is set to "1.520"; the Absorption Index is set to "0.1"; the Size Range is set to "0.020 μm" to "2000.000 μm"; the Obscuration is set to "Default"; the Sampler Settings is set to "2000 rpm"; the Measurement Time is set to "15 seconds"; the Measurement Snaps is set to "15000"; the Background time is set to "15 seconds"; the Background Snaps is set to "15000"; the Result Emulation is selected as "Off"; and the wet sample system optical cell is installed in to the Mastersizer bench. The Dispersant Refractive Index is set to the RI value of the fluid in which the particles are suspended during measurement, wherein the RI value of the fluid was measured using a refractometer at a wavelength of 589 nm and a temperature of 20° C. This RI value may be available from the manufacturer of the fluid.

The test sample is added to stirrer unit until the desired obscuration is obtained, as indicated by the software display. The analysis is started and the instrument is allowed to run until the measurement is complete. The Wet Sample System must be cleaned between each sample measurement by rinsing with the dispersant fluid several times until the cell is clean of any particles.

The distribution metrics measured via the wet feeder are reported following the same instructions specified for measurements obtain via the dry feeder.

Mean Particle Size of Hydrophobic Conditioning Agent Test Method

The mean particle size value of the hydrophobic conditioning agent in a consumer product composition of the present invention is the volume-weighted average diameter of droplets in an aqueous dispersion formed upon dissolution of the test sample of the consumer product composition in deionized (DI) water, as measured according to the following method. The measurement of this diameter is conducted using static light scattering techniques via a Laser Scattering Particle Size Distribution Analyzer and its accompanying software. The Analyzer instrument used is the Horiba model LA-960S with LA-960 analysis software (Horiba Ltd., Kyoto, Japan), equipped with a quartz cuvette-type static small fraction cell sample holder, of 10 mL capacity (part #3200090354 Horiba Ltd., Kyoto, Japan). This sample holder cell is used for all droplet size measurements within this test method.

Within the instrument software: the Iteration Mode is selected as Auto; and the Distribution Base is set as Volume. The refractive index (RI) value of the continuous phase is set as the RI value of water by selecting Water from the instrument software library, which inserts a RI value of 1.3333. The RI value of the dispersed phase is set as the RI value of the predominant hydrophobic conditioning agent (by wt %) present in the dispersed phase and is set by selecting that material within the software library. Within the Horiba LA-960 software library, e.g., 1.40-0.00i(1.33) is the preferred selection for amino functionalized silicones dispersed in water. If the predominant hydrophobic conditioning agent of the dispersed phase is not listed within the software library, then the RI value entered is the value determined by measuring the RI of that material using a refractometer at a wavelength of 589 nm and temperature of 20° C. This RI value may be available from the manufacturer of the conditioning agent material.

A clean sample holder cell is filled with DI water and placed into the fixed cell holder inside the instrument. The secured cell is moved into the locked position and the instrument door is closed. The cell is aligned in the instrument and the background is subtracted by choosing the "Blank" option within the software. When the background measurement is finished, the cell is removed and emptied. A 0.03 wt % aqueous sample dispersion of the consumer product composition to be tested is made by dissolving 0.30±0.05 g of the test sample in 1000.0 g of DI water. The sample dispersion is made in a flat bottomed disposable plastic beaker of approximately 1 L volume using DI water having a temperature of 23±2° C., and the mixture is immediately stirred at 600 rpm for 10 minutes. After stirring, an aliquot of the sample dispersion is immediately drawn from the middle of the volume, avoiding any macroscopic material. The sample aliquot is quickly transferred into a clean sample holder cell, and all visible air bubbles are removed. The filled cell is inserted into the instrument, secured, moved into the locked position, and then the loading door is completely closed. Neither the sample of the test composition, nor the DI water background blank is stirred during the blanking or measurement processes.

With the test sample loaded in the instrument, the values for the Laser T % and Lamp T % light transmittance parameters are assessed via the display in the instrument software. Both of these T % parameters are required to fall within the approximate center third of the respective instrument-specified acceptable ranges before measurement data can be collected. The instrument-specified acceptable ranges for both parameters are 70% to 95% and are viewable from the measurement window of the analysis software. If the test sample % T values are higher than the center third of this range, then the sample is diluted with DI water until the sample registers T % values within the zones specified. If the % T values are below the center third of the ranges, the test sample is remade at a higher wt % concentration such that the T % parameter requirements are satisfied. The measurement analysis is conducted promptly once the T % value requirements are satisfied. It is important that the droplet size measurement is conducted within 10 mins of completing the sample preparation stir time, in order to minimize coalescence of droplets.

Each composition being tested is prepared and measured in at least three replicate dispersions of a suitable concentration. Each replicate sample is weighed and dissolved separately. Each replicate sample is measured after performing a rinse step which uses that sample preparation as the rinsing liquid. Since a prepared dispersion may not be stable after preparation, all testing of a dispersion is conducted within the 10 min time period after the stirring period is complete. After each particle size measurement analysis, the instrument software displays a volume-weighted plot of Frequency (%) versus Diameter (μm), as well as the value of the mean volume-weighted particle diameter. The distribution data displayed in the graphs and used in the calculation of the mean are then truncated to discard diameter values greater than 50 μm. The truncation is conducted by selecting Graph Axes, and entering in the Scale section: the Min Value as 0.01; and the Max Value as 50; and then in the Calculation section checking Recalculate Using Axis Range and then OK. The mean diameter values from the truncated distributions of three replicate preparations are averaged using the Average function within the software to determine the volume-weighted average diameter in micrometers, which is then reported as the mean particle size value for the hydrophobic conditioning agent of the test composition.

Dissolution Rate Test Method

A preferred particulate spacer material has a dissolution rate in water which is slower than that of the carrier material. The dissolution rate of the spacer and the dissolution rate of the carrier material are each measured and reported in accordance with the following specified procedures.

Measurements are conducted using an upright, bright field light microscope, such as a Nikon Eclipse E600 POI, (Nikon Instruments Inc., Melville, N.Y., U.S.A.) or equivalent. The microscope is equipped with a set of objective lenses suitable for providing fields of view in the captured images spanning at least the range of 20 μm-1000 μm, in order to visualize an entire single grain of the spacer or carrier material. The microscope is equipped with a digital camera such as an Evolution VP Monochrome camera (Media Cybernetics Inc., Rockville, Md., U.S.A.) or equivalent, such that the system is capable of capturing images with a scale of 0.1 μm per pixel. The instrument system is also equipped with a camera-controlling image analysis software program such as Image-Pro Premier (Media Cybernetics Inc., Rockville, Md., U.S.A.), capable of acquiring images at precise time intervals. The microscope may be additionally equipped with contrast-enhancing optics such as differential interference contrast or phase contrast, if these are required to adequately image the dimensions of a given particle when mounted in water. For each objective lens, the instrument system is spatially calibrated, using the camera, image analysis software, and a stage micrometer standard reference slide, so that linear distance measurements can be accurately obtained from each captured image. The analyses are conducted in a laboratory having environmental conditions of: temperature in the range of 20° C.-25° C., and humidity in the range of 30% RH-50% RH. All equipment, samples, and materials are equilibrated to the environmental conditions of the laboratory prior to their use in the analysis.

A given test sample comprises a single spacer material particle, or a single grain of carrier material ranging in size from 20 μm-1000 μm in diameter. Each grain of carrier material contains all the chemical components of the carrier. Suitable grains of carrier material are created by using a sharp razor blade to trim or chop up larger blocks of carrier material into pieces that fall within the size range specified for the test samples. Test samples within the appropriate size range can be selected from a population of particles or grains. When selecting test samples to measure, selection preference is given to particles and grains having shapes with lower aspect ratios (i.e., short and wide), rather than those having shapes with higher aspect ratios (i.e., long and narrow). At least three replicate test samples are analyzed for each material tested.

The test sample is placed on a flat glass microscope slide or in the concave depression of a glass microscope well slide (VWR North American, West Chester, Pa., U.S.A. Cat. No. 470005-634, or equivalent). The microscope coarse focus is adjusted to bring the test particle or grain into focus. Sufficient drops of deionized (DI) water are gently dispensed onto sample such that the sample is completely immersed. The microscope fine focus is adjusted to bring the sample's lateral surfaces into sharp focus. The test sample is left completely quiescent and without heating or cooling for the duration of the measurement time period. The selection of objective lens, slide, coverslip, and water volume are all chosen to enable the test particle to be quickly and easily brought into focus (within 5 seconds of water being added), and to permit the entire particle to be viewed in each captured image such that the particle dimensions can be measured accurately.

Once 5 seconds have elapsed after the addition of water to the sample, images of the test sample are captured as the test sample interacts with the water for shorter of either: thirty minutes, or until the sample has completely dissolved. The frame rate is chosen to ensure that a minimum of four images are collected before the endpoint. For example, materials specified in the Examples below, are analyzed using image capture frame rates that resulted in intervals of between 5-30 seconds elapsing between consecutive images. For each captured image, the time elapsed between the time point at which water was added to the sample (i.e., time zero and the time, point at which the image was captured is recorded in seconds.

The captured images are inspected and images which were captured approximately at or after the time of complete dissolution of the test sample are discarded. At least four images are then selected from the remaining set of images, such that the four images selected are spaced at approximately equal time intervals and include the first and last images from the non-discard set. The dissolution rate of a test sample is determined by measuring the rate at which the lateral surfaces of the sample recede as the sample dissolves in the water. Within each selected image, the image analysis software is used to measure two linear distances between opposing surfaces. The first measurement is the length of the particle or grain measured along its longest axis. The second measurement is the width of the particle or grain measured along the axis orthogonal to its longest axis, bisecting (i.e., at the midpoint of) the longest axis. The measured length and width distances (in micrometers) are each plotted versus the elapsed time (in seconds) of the respective image. For each test sample, at least three data points are plotted for length and at least three data points are plotted for width. A straight line is drawn using linear least squares regression through each length and width data set, respectively, and the slope of each line is calculated. The slopes of the two lines are averaged. if the average is zero, the test material is defined as water-insoluble (and Dissolution Rate reported as 0 μm $s^{-1}$). If the average is not zero, this average slope is reported as the Dissolution Rate of the test material and is reported in micrometers per second (μm $s^{-1}$).

Molecular Weight Test Method

The molecular weight of a PEG material is determined according to the following test method.

Matrix-Assisted Laser Desorption Ionization Time-Of-Flight (MALDI-TOF) is used in this test method. Mass Spectrometry is a soft ionization technique that can be used for the analysis of molecular weight of biomolecules such as proteins and large organic molecules such as polymers. In MALDI, the analyte is first mixed and co-crystallized with a UV absorbing matrix such as alpha-cyano-4-hydroxycinnamic acid (CHCA), then subjected to pulse laser (YAG or nitrogen laser) radiation. Ions generated are transmitted into a mass analyzer for detection.

To measure the distribution of molecular weights and determine the molecular weight (Mw) to report for a polymer material, between 2 mg and 3 mg of polymer sample are weighed out in a plastic microcentrifuge tube and dissolved in 1 mL of deionised water (DI water). After mixing thoroughly on a vortex mixer, the sample is further diluted 10 times with DI water. Five microliters of the dilute sample solution is mixed with 5 uL of MALDI matrix α-cyano-4-hydroxycinnamic acid solution (i.e., 10 mg/mL CHCA in 80% acetonitrile/water (vol/vol), with 0.1% trifluroacetic acid (vol/vol)), then 1 uL of 50 mM potassium chloride is added and the mixture is thoroughly mixed. One microliter of this mixture is spotted onto a MALDI stainless steel plate and allowed to dry in air at room temperature immediately prior to MALDI analysis. A MALDI-TOF/TOF (such as the model 4800 Plus system from AB-Sciex, Framingham, Mass., U.S.A.) is used in the positive ion linear mode to collect molecular weight measurements. The AB-Sciex MALDI-TOF/TOF 4800 Plus mass spectrometer uses a 200 Hz frequency Nd:YAG laser, operating at a wavelength of 355 nm and with the laser intensity set at 4500 V. Ions generated by the MALDI process are accelerated at 20 kV. MALDI mass spectra are generated in the mass range 5000-12000 Da. Data is collected in an automated fashion using random sampling over the sample spot to collect a total of 1000 shots per spectrum. The molecular weights measured are plotted as a MALDI spectrum histogram displaying the frequency distribution of molecular weight values measured in the sample. The molecular weight value reported for the sample is the molecular weight value corresponding to the top of the peak in the plotted distribution.

Relative Staining Index Test Method

Materials used in this test method include: Eight fabric swatches (Casa Collection Crepe Calypso—Coral 100% Polyester, Joanne Fabric catalog #1068-2094) are cut into −75 mm×75 mm squares. Eight ballast swatches (Terry Towels) are cut into 75 mm×75 mm squares. Two 500 mL wide mouth jars (VWR, Cat. No. 89093-982, or equivalent) are readied. A stock wash solution is prepared by thoroughly mixing 1.64 gram of Tide Original HE laundry detergent (#92111108) in 2.0 L of deionized water.

Single Simulated Wash Procedure: To create a single washer jar, four fabric swatches are weighed and four ballast swatches are weighed. These swatches are alternately layered with one-on-top-of-the-other and inserted edge-on into the one jar. The process is repeated to fill a second single jar, and then 150 mL of stock wash solution is added to each of the two jars. They are capped and shaken briskly until all the swatches are completely wet. The caps are removed. Two sets of beads comprising 10 beads in each set are both weighed. One set of beads is added to one single jar and the other set is added to the other single jar. The jars are quickly sealed, shaken up-and-down by hand several times and placed on opposite sides of the rotator mixer (Glas-Col LLC, Terre Haute, Ind., cat #099A RD4512). The rotator mixer is pre-set to a power of 40 (30 revolutions per minute) and switched on to mimic the rotational motion of a laundry wash drum. The entire process from adding beads to switching on the rotator should take no longer than 15 seconds.

Single Simulated Rinse Procedure: The rotator mixer is stopped after 20 minutes. The jars are removed from the rotator mixer, the caps are removed and the excess wash solution is poured from the both jars. Then, 150 mL of deionized water is added to each jar, the cap is replaced and the jar shaken briskly. The cap is removed, and the excess water is again poured from both jars. An additional 150 mL of deionized water is added to each jar, the cap is replaced and the jars are reset on the rotator mixer. The rotator mixer which is still pre-set to a power of 40 (30 revolutions per minute) is switched on for 20 minutes.

Single Simulated Dry Procedure: The rotator mixer is stopped. The jars are removed from the rotator mixer, the caps are removed and the excess rinse water is poured from each jar. The polyester fabric swatches are removed from the jars, squeezed to remove excess water and laid out on an open tray. The tray is placed in an Analytical Convection Oven (Yamato, Cat. No. DKN400 or equivalent) set to 70° C. They are removed from the Oven immediately when completely dry. The terry towel ballast swatches are discarded.

The entire process is repeated at least two times (and as many as three times) using control beads (lacking spacers). The entire process (and the repeats) is then conducted with test beads (containing spacers). These four to six runs result in 32 to 48 polyester fabric swatches, which are subsequently graded in order to determine the Relative Staining Index.

Stain Grading Swatches: If the consumer product composition is observed not to have fully dissolved, the Relative Staining Index is not reported and instead is noted as "insufficient dissolution". Otherwise, the dried polyester fabric swatches are spread out on a well-lit flat surface, to inspect them for the presence of stains. Stains from the HCA can appear as light or dark marks (e.g. circles, smudges) on either side of the fabric swatches. For the entire set of fabric swatches from all control bead and spacer bead experiments, the number of stains on each swatch is counted and averaged for each type of bead respectively. The Relative Staining Index is calculated as the average number of stains per fabric swatch in the spacer bead samples divided by the average number of stains per fabric swatch in the control bead samples. For example, if the spacer beads show an average of 0.06 stains per swatch, and the control beads show an average of 2.0 stains per swatch, the relative stain index equals a value of 0.03, which indicates a 97% reduction in staining as a consequence of the inclusion of the spacers in the beads.

Dissolution Time Test Method

The Dissolution Time is the average of three single measurements of the amount of time it takes a single bead of the consumer product composition (as described in the Examples below) to completely dissolve; it is relevant to the complete dissolution of the bead in the wash cycle. For the method, a VWR Multi-Position Stirrer (VWR North American, West Chester, Pa., U.S.A. Cat. No. 12621-046) was equipped with three 15 mL beakers (VWR North American, West Chester, Pa., U.S.A. Cat. No. 10754-950), each containing a stir bar (VWR North American, West Chester, Pa., U.S.A. Cat. No. 58948-138), and 100 mL of 25° C.±2° C. deionized water.

The speed of the stir bar is set to 300 RPM, and a single bead, hemispherical in shape with a diameter of approximately 5 mm and of known weight, is placed in each beaker. A stopwatch is used to record the elapsed time between the time point at which the bead is immersed and the time point at which the bead is no longer visible in the beaker as monitored macroscopically at arm's length under bright room lights in each beaker. If, in any beaker, a bead sticks on either the side or bottom of the beaker, the beaker was readjusted until the bead freely moves in the solution.

The Dissolution Time is reported as the average (mean) time of the three trials.

Examples

Each consumer product composition of the Examples and Comparative Examples below contains a hydrophobic conditioning agent ("HCA") material, a carrier material, and a particulate spacer material, and is made using the following method. A total of 60 grams of each consumer product composition are prepared as follows. The amounts of carrier material, particulate spacer material, and HCA material added to form the composition are based on the weight percent amounts provided in the Examples and Comparative Examples below.

The carrier material is weighed into a 60 g MAX speed mix container (Flacktek, Inc., Landrum, S.C., USA), then melted in an 80±5° C. oven to create the carrier hot melt. The HCA material is weighed and added to the same container as the carrier hot melt. The container, which is sealed closed with a plastic lid, is placed in an 80° C. oven for one hour to allow the contents to reach the oven temperature. The container is then removed from the oven, placed in a 60 max speed mixer holder, and speed mixed for 30 seconds at 3500 rpm in a Flacktek DAC150.FVZ-K speed mixer. The resulting composition mixture is then partitioned by weight into two equal parts: one part is transferred to a preheated mold with indentations to form defined 5-mm diameter, hemispherical bead shapes to form "control beads" used in the RELATIVE STAINING INDEX TEST METHOD described above; the other part is added to a beaker containing pre-weighed, pre-heated spacer material and mixed by hand with a spatula, returned to an 80° C. oven for one minute, mixed by hand using a spatula a second time, then transferred to a preheated mold with indentations to form defined 5 mm diameter, hemi-spherical bead shapes. The mixtures are evenly spread into the mold indentations using a six-inch or twelve-inch flexible joint knife. The composition mixtures are then allowed to cool to room temperature to solidify, at which time the composition is removed from the mold.

The resulting consumer product compositions, which are in the form of a plurality of hemispherical beads, are tested according to the RELATIVE STAINING INDEX TEST METHOD and the DISSOLUTION TIME TEST METHOD described hereinabove.

The following HCA materials, carrier materials, and spacer materials are utilized and denoted in the Examples and Comparative Examples below as follows.

HCA Materials:

"MS+"=Terminal aminosilicone available under the tradename MagnaSoft Plus from Momentive, Lot#13DSVM054E "TAS"=Dimethyl, methyl (3-aminopropyl) siloxane, trimethylsiloxy-terminated, CAS-No. 99363-37-8, wherein k is about 500 and m is about 2.5.

Carrier Materials:

"PEG 8000"=Polyethylene glycol having a molecular weight of 8000 available under the tradename Pluriol E 8000 prill from BASF Corp (Geismar, US) Lot: GN533802B Spacer Materials:

"A"=Soda Lime Glass Microspheres available from Cospheric LLC (Santa Barbara, Calif., USA) under the tradename SLGMS-2.5 (500-600 μm)

"B"=Soda Lime Glass Microspheres available from Cospheric LLC (Santa Barbara, Calif., USA) under the tradename SLGMS-2.5 (180-212 μm)

"C"=Polyethylene Microspheres available from Cospheric LLC (Santa Barbara, Calif., USA) under the tradename UVPMS-BG-1.00 (180-212 μm)

"D"=Soda Lime Glass Microspheres available from Cospheric LLC (Santa Barbara, Calif., USA) under the tradename SLGMS-2.5 (90-106 μm)

"E"=Potato Starch available from Acros Organics as starch, extra pure, potato, powder; code: 419695000; Lot: A036876

"F"=Potato Starch available from Alfa Aesar as starch, from potato, soluble; A11961; Lot: 10192010

"G"=Soda Lime Glass Microspheres available from Cospheric LLC (Santa Barbara, Calif., USA) under the tradename SLGMS-2.5 (45-53 μm)

"H"=Soda Lime Glass Microspheres available from Cospheric LLC (Santa Barbara, Calif., USA) under the tradename SLGMS-2.5 (10-22 μm)

"I"=EMD Sodium Chloride Lot: TC09CZEMS

"J"=Sodium Bicarbonate available from Arm & Hammer Lot: FF5321

"K"=Hollow Glass Microspheres available from Cospheric LLC (Santa Barbara, Calif., USA) under the tradename HGMS-0.46 (45-53 μm)

"L"=Borosilicate Solid Glass Microspheres available from Cospheric LLC (Santa Barbara, Calif., USA) under the tradename BSGMS-0.46 (45-53 μm)

"M"=Poly Vinyl Alcohol available from Alfa Aesar as 87-89% hydrolyzed, high MW; stock: 41240; lot: F07W019

"N"=Borax powder 5 mol. available from Univar USA Inc (Cincinnati, US) Lot: 3G2

The following Examples 1-11 are consumer product compositions of the present invention, which exhibit desired Relative Staining Index and Dissolution Time values.

| EXAMPLE | 1 | 2 | 3 | 4 | 5 |
|---|---|---|---|---|---|
| MATERIALS | | | | | |
| Spacer Material | A | B | B | C | B |
| Carrier Material | PEG 8000 | PEG 8000 | PEG 8000 | PEG 8000 | PEG 8000 |
| HCA Material | TAS | MS+ | MS+ | TAS | MS+ |
| PROPERTIES | | | | | |
| Mean Particle Size of Spacer | 584.7 μm | 210.4 μm | 210.4 μm | 191.8 μm | 210.4 μm |

-continued

| EXAMPLE | 1 | 2 | 3 | 4 | 5 |
|---|---|---|---|---|---|
| Spacer Polydispersity | 0.531 | 0.61 | 0.61 | 0.558 | 0.61 |
| Dissolution Rate of Spacer | 0 $\mu m\ s^{-1}$ | 0 $\mu m\ s^{-1}$ | 0 $\mu m\ s^{-1}$ | 0 $\mu m\ s^{-1}$ | 0 $\mu m\ s^{-1}$ |
| Dissolution Rate of Carrier | −1.72 $\mu m\ s^{-1}$ | −1.72 $\mu m\ s^{-1}$ | −1.72 $\mu m\ s^{-1}$ | −1.72 $\mu m\ s^{-1}$ | −1.72 $\mu m\ s^{-1}$ |
| Ratio of Dissolution Rates of Carrier:Spacer | N/A | N/A | N/A | N/A | N/A |
| Spacer Density | 2.5 $g\ cm^{-3}$ | 2.5 $g\ cm^{-3}$ | 2.5 $g\ cm^{-3}$ | 0.97 $g\ cm^{-3}$ | 2.5 $g\ cm^{-3}$ |
| Spacer Shape | Sphere | Sphere | Sphere | Sphere | Sphere |
| Vol. Fraction of Spacer | 0.283 | 0.091 | 0.165 | 0.163 | 0.286 |
| Mean Particle Size of HCA | 11.7 μm | 11.8 μm | 10.7 μm | 14.3 μm | 11.3 μm |
| Conc. of Spacer | 49.7 wt. % | 20 wt. % | 33 wt. % | 16 wt. % | 50 wt. % |
| Conc. of Carrier | 35.2 wt. % | 67 wt. % | 56.1 wt. % | 59.6 wt. % | 41.9 wt. % |
| Conc. of HCA | 15.1 wt. % | 13.0 wt. % | 10.9 wt. % | 24.4 wt. % | 8.1 wt. % |
| PERFORMANCE | | | | | |
| Relative Staining Index | 0.07 | 0.26 | 0.07 | 0.18 | 0.03 |
| Dissolution Time | 9:30; 10:30; 11:15 | 10:00; 10:40; 12:30 | 11:12; 12:57; 13:10 | 11:30, 12:20, 13:00 | 15:50; 16:43; 17:00 |

| EXAMPLE | 6 | 7 | 8 | 9 | 10 |
|---|---|---|---|---|---|
| MATERIALS | | | | | |
| Spacer Material | C | C | D | D | D |
| Carrier Material | PEG 8000 | PEG 8000 | PEG 8000 | PEG 8000 | PEG 8000 |
| HCA Material | TAS | TAS | MS+ | MS+ | MS+ |
| PROPERTIES | | | | | |
| Mean Particle Size of Spacer | 191.8 μm | 191.8 μm | 111.2 μm | 111.2 μm | 111.2 μm |
| Spacer Polydispersity | 0.558 | 0.558 | 0.602 | 0.602 | 0.602 |
| Dissolution Rate of Spacer | 0 $\mu m\ s^{-1}$ | 0 $\mu m\ s^{-1}$ | 0 $\mu m\ s^{-1}$ | 0 $\mu m\ s^{-1}$ | 0 $\mu m\ s^{-1}$ |
| Dissolution Rate of Carrier | −1.72 $\mu m\ s^{-1}$ | −1.72 $\mu m\ s^{-1}$ | −1.72 $\mu m\ s^{-1}$ | −1.72 $\mu m\ s^{-1}$ | −1.72 $\mu m\ s^{-1}$ |
| Ratio of Dissolution Rates of Carrier:Spacer | N/A | N/A | N/A | N/A | N/A |
| Spacer Density | 0.97 $g\ cm^{-3}$ | 0.97 $g\ cm^{-3}$ | 2.5 $g\ cm^{-3}$ | 2.5 $g\ cm^{-3}$ | 2.5 $g\ cm^{-3}$ |
| Spacer Shape | Sphere | Sphere | Sphere | Sphere | Sphere |
| Vol. Fraction of Spacer | 0.295 | 0.462 | 0.091 | 0.165 | 0.286 |
| Mean Particle Size of HCA | 9.9 μm | 12.3 μm | 14.6 μm | 10.2 μm | 9.4 μm |
| Conc. of Spacer | 28.9 wt. % | 44.8 wt. % | 20 wt. % | 33 wt. % | 50 wt. % |
| Conc. of Carrier | 50.5 wt. % | 38.6 wt. % | 67 wt. % | 56.1 wt. % | 41.9 wt. % |
| Conc. of HCA | 20.6 wt. % | 16.6 wt. % | 13 wt. % | 10.9 wt. % | 8.1 wt. % |
| PERFORMANCE | | | | | |
| Relative Staining Index | 0.03 | 0.02 | 0.44 | 0.37 | 0.04 |
| Dissolution Time | ~14 | ~18 | 9:50; 10:40; 11:40 | 12:56; 13:12; 13:30 | 13:00; 17:00; 17:00 |

| EXAMPLE | 11 |
|---|---|
| MATERIALS | |
| Spacer Material | N |
| Carrier Material | PEG 8000 |
| HCA Material | TAS |

-continued

| EXAMPLE | 11 |
|---|---|
| PROPERTIES | |
| Mean Particle Size of Spacer | 518.15 μm |
| Spacer Polydispersity | 1.27 |

-continued

| EXAMPLE | 11 |
|---|---|
| Dissolution Rate of Spacer | −0.68 μm $s^{-1}$ |
| Dissolution Rate of Carrier | −1.72 μm $s^{-1}$ |
| Ratio of Dissolution Rates of Carrier:Spacer | 2.53 |
| Spacer Density | 1.73 g $cm^{-3}$ |
| Spacer Shape | Crystalline |
| Vol. Fraction of Spacer | 0.163 |
| Mean Particle Size of HCA | 10.0 μm |

-continued

| EXAMPLE | 11 |
|---|---|
| Conc. of Spacer | 33.0 wt. % |
| Conc. of Carrier | 47.6 wt. % |
| Conc. of HCA | 19.4 wt. % |
| PERFORMANCE | |
| Relative Staining Index | 0.13 |
| Dissolution Time | 10:10, 10:15, 10:45 |

The following Comparative Examples A-M are consumer product compositions that do not exhibit desired Relative Staining Index and/or Dissolution Time values, as compared to consumer product compositions of the present invention.

| EXAMPLE | A | B | C | D | E |
|---|---|---|---|---|---|
| MATERIALS | | | | | |
| Spacer Material | E | F | G | G | G |
| Carrier Material | PEG 8000 | PEG 8000 | PEG 8000 | PEG 8000 | PEG 8000 |
| HCA Material | TAS | TAS | MS+ | MS+ | MS+ |
| PROPERTIES | | | | | |
| Mean Particle Size of Spacer | 43.0 μm | 40 μm | 52.5 μm | 52.5 μm | 52.5 μm |
| Spacer Polydispersity | 1.30 | 1.33 | 0.60 | 0.60 | 0.60 |
| Dissolution Rate of Spacer | 0 μm $s^{-1}$ | 0 μm $s^{-1}$ | 0 μm $s^{-1}$ | 0 μm $s^{-1}$ | 0 μm $s^{-1}$ |
| Dissolution Rate of Carrier | −1.72 μm $s^{-1}$ | −1.72 μm $s^{-1}$ | −1.72 μm $s^{-1}$ | −1.72 μm $s^{-1}$ | −1.72 μm $s^{-1}$ |
| Ratio of Dissolution Rates of Carrier:Spacer | N/A | N/A | N/A | N/A | N/A |
| Spacer Density | 1.0 g $cm^{-3}$ | 1.0 g $cm^{-3}$ | 2.5 g $cm^{-3}$ | 2.5 g $cm^{-3}$ | 2.5 g $cm^{-3}$ |
| Spacer Shape | Oblong | Oblong | Sphere | Sphere | Sphere |
| Vol. Fraction of Spacer | 0.297 | 0.299 | 0.091 | 0.165 | 0.286 |
| Mean Particle Size of HCA | 14.7 μm | 13.6 μm | 11.4 μm | 9.9 μm | 11.9 μm |
| Conc. of Spacer | 29.7 wt. % | 29.9 wt. % | 20 wt. % | 33 wt. % | 50 wt. % |
| Conc. of Carrier | 49.9 wt. % | 49.8 wt. % | 67 wt. % | 56.1 wt. % | 41.9 wt. % |
| Conc. of HCA | 20.4 wt. % | 20.3 wt. % | 13.0 wt. % | 10.9 wt. % | 8.1 wt. % |
| PERFORMANCE | | | | | |
| Relative Staining Index | 0.93 | >>1.0 | insufficient dissolution | insufficient dissolution | insufficient dissolution |
| Dissolution Time | 17:34; 20:00, 22:00 | T > 30 | 10:00; 11:30; 12:30 | 13:04; 14:20; 14:40 | 12:09; 17:24; 18:00 |

| EXAMPLE | F | G | H | I | J |
|---|---|---|---|---|---|
| MATERIALS | | | | | |
| Spacer Material | L | H | I | I | J |
| Carrier Material | PEG 8000 | PEG 8000 | PEG 8000 | PEG 8000 | PEG 8000 |
| HCA Material | TAS | TAS | TAS | TAS | TAS |
| PROPERTIES | | | | | |
| Mean Particle Size of Spacer | 52.6 μm | 19.3 μm | 392.2 μm | 392.2 μm | 115.4 μm |
| Spacer Polydispersity | 0.60 | 0.643 | 0.989 | 0.989 | 1.28 |
| Dissolution Rate of Spacer | 0 μm $s^{-1}$ | 0 μm $s^{-1}$ | −3.90 μm $s^{-1}$ | −3.90 μm $s^{-1}$ | −1.56 μm $s^{-1}$ |
| Dissolution Rate of Carrier | −1.72 μm $s^{-1}$ | −1.72 μm $s^{-1}$ | −1.72 μm $s^{-1}$ | −1.72 μm $s^{-1}$ | −1.72 μm $s^{-1}$ |
| Ratio of Dissolution Rates of Carrier:Spacer | N/A | N/A | 0.44 | 0.44 | 1.10 |
| Spacer Density | 2.16 g $cm^{-3}$ | 2.5 g $cm^{-3}$ | 2.16 g $cm^{-3}$ | 2.16 g $cm^{-3}$ | 2.2 g $cm^{-3}$ |
| Spacer Shape | Sphere | Sphere | Cube | Cube | Granule |

-continued

| EXAMPLE | F | G | H | I | J |
|---|---|---|---|---|---|
| Vol. Fraction of Spacer | 0.131 | 0.274 | 0.303 | 0.185 | <0.01 |
| Mean Particle Size of HCA | 9.4 μm | 6.7 μm | 8.5 μm | 12.7 μm | 10.5 μm |
| Conc. of Spacer | 24.7 wt. % | 48.6 wt. % | 48.5 wt. % | 33.3 wt. % | 1.0 wt. % |
| Conc. of Carrier | 53.5 wt. % | 36.0 wt. % | 36.6 wt. % | 47.4 wt. % | 70.3 wt. % |
| Conc. of HCA | 21.8 wt. % | 15.4 wt. % | 14.9 wt. % | 19.3 wt. % | 28.7 wt. % |
| PERFORMANCE | | | | | |
| Relative Staining Index | insufficient dissolution | insufficient dissolution | 1.18 | 0.90 | 0.82 |
| Dissolution Time | 12:00, 12:10, 12:20 | T > 30 | 6:22; 6:30; 6:45 | 8:00; 8:20; 8:30 | 9:00, 9:10, 9:30 |

| EXAMPLE | K | L | M |
|---|---|---|---|
| MATERIALS | | | |
| Spacer Material | J | K | M |
| Carrier Material | PEG 8000 | PEG 8000 | PEG 8000 |
| HCA Material | TAS | TAS | TAS |
| PROPERTIES | | | |
| Mean Particle Size of Spacer | 115.4 μm | 38.6 μm | 793.0 μm |
| Spacer Polydispersity | 1.28 | 1.40 | 0.89 |
| Dissolution Rate of Spacer | $-1.56\ \mu m\ s^{-1}$ | $0\ \mu m\ s^{-1}$ | $+0.07\ \mu m\ s^{-1}$ |
| Dissolution Rate of Carrier | $-1.72\ \mu m\ s^{-1}$ | $-1.72\ \mu m\ s^{-1}$ | $-1.72\ \mu m\ s^{-1}$ |
| Ratio of Dissolution Rates of Carrier:Spacer | 1.10 | N/A | −24.57 |
| Spacer Density | $2.20\ g\ cm^{-3}$ | $0.46\ g\ cm^{-3}$ | $1.19\ g\ cm^{-3}$ |
| Spacer Shape | Granule | Sphere | Crystalline |
| Vol. Fraction of Spacer | 0.046 | 0.413 | 0.292 |
| Mean Particle Size of HCA | 10.2 μm | 7.3 μm | 10.2 μm |
| Conc. of Spacer | 9.7 wt. % | 24.5 wt. % | 33.0 wt. % |
| Conc. of Carrier | 64.1 wt. % | 53.6 wt. % | 47.6 wt. % |
| Conc. of HCA | 26.2 wt. % | 21.9 wt. % | 19.4 wt. % |
| PERFORMANCE | | | |
| Relative Staining Index | 0.80 | 0.12 | Stains, undiss. PVA |
| Dissolution Time | 7:45, 7:50, 8:20 | >30 | 8-10 PEG (PVA residue) |

The consumer product compositions of Comparative Examples A-M above fail to exhibit desired Relative Stain Index and/or Dissolution Time values due to undesirable mean particle size of the spacer material and/or ratio of dissolution rate of the spacer material to the dissolution rate of the carrier material.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product composition comprising:

a) a non-porous dissolvable solid structure comprising polyethylene glycol as a carrier material;

b) a hydrophobic conditioning agent disposed within said carrier material, wherein said hydrophobic conditioning agent is a terminal aminosilicone or a polydimethyl siloxane that has a mean particle size of from about 1 μm to about 500 μm; and c) a particulate spacer material disposed within said carrier material, wherein said particulate spacer material is selected from the group consisting of glass microspheres, ceramic microspheres, polyalkylene microspheres, alkali metal borates, and mixtures thereof, and has a mean particle size of from about 55 μm to about 750 μm;

wherein said non-porous dissolvable solid structure of said consumer product composition comprises a volume fraction of said particulate spacer material of from about 0.05 to about 0.50; and wherein said particulate spacer material is water-insoluble or a ratio of dissolution rate of said carrier material to dissolution rate of said particulate spacer material is at least about 2.

2. The consumer product composition of claim 1, wherein said mean particle size of said particulate spacer material is greater than said mean particle size of said hydrophobic conditioning agent.

3. The consumer product composition of claim 1, wherein a ratio of said mean particle size of said particulate spacer material to said mean particle size of said hydrophobic conditioning agent is at least about 5:1.

4. The consumer product composition of claim 1, wherein said mean particle size of said particulate spacer material is from about 75 μm to about 650 μm.

5. The consumer product composition of claim 1, wherein said consumer product composition comprises from about 5% to about 50%, by weight of said consumer product composition, of said particulate spacer material.

6. The consumer product composition of claim 1, wherein said non-porous dissolvable solid structure of said consumer product composition comprises a volume fraction of said particulate spacer material of from about 0.1 to about 0.5.

7. The consumer product composition of claim 1, wherein said particulate spacer material is water-insoluble.

8. The consumer product composition of claim 1, wherein said particulate spacer material is a solid at 70° C.

9. The consumer product composition of claim 1, wherein said particulate spacer material is colored, preferably said particulate spacer material having a color different from said carrier material such that a visual contrast is obtained between said carrier material and said particulate spacer material.

10. The consumer product composition of claim 1, wherein the mean particle size of said hydrophobic conditioning agent disposed within said carrier material is from about 1 μm to about 500 μm.

11. The consumer product composition of claim 1, wherein said consumer product composition comprises at least about 1%, by weight of said consumer product composition, of said hydrophobic conditioning agent.

12. The consumer product composition of claim 1, wherein said consumer product composition comprises from about 30% to about 95%, by weight of the consumer product composition, of said carrier material.

13. The consumer product composition of claim 1, wherein said hydrophobic conditioning agent is a liquid at 25° C.

14. The consumer product composition of claim 1, wherein said carrier material has a viscosity at 70° C. of from about 0.005 to about 350 Pa·s.

15. The consumer product composition of claim 1, wherein said carrier material has a melting point of from about 25° C. to about 120° C. and is a solid at 25° C.

16. The consumer product composition of claim 1, wherein said carrier material comprises a polyethylene glycol material having a molecular weight of from about 200 to about 50,000.

17. The consumer product composition of claim 1, wherein said consumer product composition is in the form of a plurality of beads, having an average maximum cross-sectional dimension of from about 0.05 to about 50 mm.

18. The consumer product composition of claim 1, wherein said consumer product composition comprises less than about 5%, by weight of said consumer product composition, of water.

19. The consumer product composition of claim 1, wherein said consumer product composition comprises less than about 5%, by weight of said consumer product composition, of detersive surfactant and/or cleansing surfactant.

20. The consumer product composition of claim 1, wherein said consumer product composition further comprises a filler material selected from the group consisting of inorganic salts, carbohydrates, clays, metal oxides, zeolites, silicas, and urea.

21. A method of treating a surface comprising the steps of:

providing a consumer product composition according to claim 1;

providing an aqueous solution;

dissolving said consumer product composition in said aqueous solution to form an aqueous treatment liquor; and contacting said surface with said aqueous treatment liquor.

* * * * *